US007878144B2

(12) United States Patent
Owatari et al.

(10) Patent No.: US 7,878,144 B2
(45) Date of Patent: Feb. 1, 2011

(54) ELECTROLESS PLATING APPARATUS AND ELECTROLESS PLATING METHOD

(75) Inventors: Akira Owatari, Tokyo (JP); Yasuhiko Saijo, Fujisawa (JP); Junichiro Tsujino, Tokyo (JP)

(73) Assignee: Ebara Corporation, Tokyo (JP)

( * ) Notice: Subject to any disclaimer, the term of this patent is extended or adjusted under 35 U.S.C. 154(b) by 1134 days.

(21) Appl. No.: 11/585,957

(22) Filed: Oct. 25, 2006

(65) Prior Publication Data

US 2007/0092658 A1 Apr. 26, 2007

(30) Foreign Application Priority Data

Oct. 25, 2005 (JP) ..... 2005-310033
Oct. 4, 2006 (JP) ..... 2006-273159

(51) Int. Cl.
*B05C 3/02* (2006.01)
*B05D 1/18* (2006.01)

(52) U.S. Cl. ..... 118/429; 118/603; 118/610

(58) Field of Classification Search ..... 210/695, 210/222–223; 118/429, 603, 610; 427/437, 427/345, 352, 443.1; 204/275.1, 660, 664; 205/80, 98–100
See application file for complete search history.

(56) References Cited

U.S. PATENT DOCUMENTS 5,795,471 A * 8/1998 Naito ..... 210/223
6,800,121 B2 * 10/2004 Shahin ..... 106/1.22

FOREIGN PATENT DOCUMENTS

JP 10-140363 5/1998

* cited by examiner

*Primary Examiner*—Laura Edwards
(74) *Attorney, Agent, or Firm*—Wenderoth, Lind & Ponack L.L.P.

(57) ABSTRACT

An electroless plating apparatus can form a protective film on exposed surfaces of embedded interconnects stably with good selectivity for thereby protecting the interconnects. The electroless plating apparatus includes a magnetic removal portion for magnetically removing small magnetic suspended solids in an electroless plating solution which have not been removed by a filter.

10 Claims, 21 Drawing Sheets

ELECTROLESS PLATING APPARATUS AND ELECTROLESS PLATING METHOD

BACKGROUND OF THE INVENTION

1. Field of the Invention

The present invention relates to an electroless plating apparatus and an electroless plating method. More particularly, the invention relates to an electroless plating apparatus and an electroless plating method for use in selectively forming a protective film of a magnetic material on exposed surfaces of embedded interconnects that are produced by embedding an interconnect material (conductive material) such as copper, silver, or the like in interconnect recesses that are provided in a surface of a substrate such as a semiconductor wafer or the like.

2. Description of the Related Art

In efforts to produce high-speed large-scale integrated (LSI) circuits in recent years, interconnects (copper interconnects) made of copper rather than an aluminum alloy have begun to be used in the art. Copper interconnects are generally produced by the so-called damascene method by forming interconnect recesses such via holes, trenches, or the like in an insulating film (interlevel dielectric film) on a substrate, depositing a thin barrier layer of tantalum or tantalum nitride (TaN) on an entire surface of the substrate including the interconnect recesses for the purposes of preventing copper from being diffused and improving the adhesiveness of copper, thereafter depositing a copper film on the barrier layer such that the copper film is embedded in interconnect recesses, and removing the copper film and the barrier layer except those buried in interconnect recesses by chemical mechanical polishing (CMP).

On a polished surface of the substrate, surfaces of interconnects (copper interconnects) made of copper embedded in the insulating film are directly exposed. If a multilevel interconnect of copper is to be formed, then another insulating film needs to be formed on exposed surfaces of the copper interconnects. Silicon oxide ($SiO_2$), which is generally used as an insulating film material, and many other materials are of poor adhesive power with respect to copper, and allow copper to be diffused quickly therein. Therefore, materials including $SiO_2$ are not generally used to form an insulating film covering exposed interconnect surfaces.

At present, only silicon nitride (SiN) and silicon carbide (SiC) are available as insulating film materials which have adhesive power with respect to copper interconnects exposed on the surface of the substrate and which are capable of preventing copper from being diffused therein. However, even these materials are not sufficiently capable of preventing copper from being diffused therein and do not have sufficient adhesive power with respect to copper. In addition, since these materials have a high dielectric constant, they tend to increase electrostatic capacitance between copper interconnects and hence to present an obstacle to attempts to reduce a delay of interconnect signals.

Recently, the use of a material of low dielectric constant, i.e., a low-K material, for producing an insulating film (interlevel dielectric film) in which to form interconnects, has been examined for reducing electrostatic capacitance between copper interconnects. Such a material of low dielectric constant generally has a low density and allows copper to be diffused at a greater rate than $SiO_2$. Therefore, a multilevel copper interconnect that is formed in an interlevel dielectric film made of a material of low dielectric constant is liable to suffer low long-term reliability.

Specifically, according to a conventional process, the exposed surfaces of copper interconnects that are formed in an insulating film (interlevel dielectric film) are covered with an insulating film that is made of a silicon compound or the like. The insulating film of a silicon compound or the like is responsible as a limitation on improved interconnects characteristics and makes it difficult to keep interconnect reliable for a long period of time.

One solution to the above problems is to selectively cover the exposed surfaces of copper interconnects with a protective film (cap material) made of an alloy of cobalt and tungsten (CoW alloy) or the like. The alloy of cobalt and tungsten (CoW alloy) or the like is produced by electroless plating, for example.

For example, as shown in FIG. 1, fine interconnect recesses (trenches) 4 are formed in an insulating film (interlevel dielectric film) 2 made of $SiO_2$, low-K material or the like, which has been deposited on a surface of a substrate W such as a semiconductor wafer. A barrier layer 6 of TaN or the like is formed on a surface of the insulating film 2, and then, for example, copper plating is carried out to deposit a copper film on the surface of the substrate W so as to embed copper in the interconnect recesses 4. Thereafter, CMP (chemical mechanical polishing) is carried out on the surface of the substrate W to planarize the surface of the substrate W, thereby forming interconnects 8 made of copper in the insulating film 2. A protective film (cap material) 9 of a CoWP alloy, which is obtained, for example, by electroless plating, is formed selectively on surfaces of the interconnects (copper) 8 so as to protect the interconnects 8.

There will be described a process of forming a protective film (cap material) 9 of a CoWP alloy selectively on surfaces of interconnects 8 by using a general electroless plating method. First, the substrate W after a CMP process is immersed, for example, in dilute sulfuric acid having an ordinary temperature for about one minute to remove an oxide film on surfaces of interconnects 8, CMP residues, such as copper, remaining on a surface of an insulating film 2 and the like. After the surface of the substrate W is cleaned (rinsed) with a cleaning liquid such as pure water, the substrate W is immersed, for example, in a $PdCl_2$/HCl mixed solution having an ordinary temperature for about one minute to adhere Pd as a catalyst to the surfaces of the interconnects 8 so as to activate exposed surfaces of the interconnects 8.

After the surface of the substrate W is cleaned (rinsed) with pure water or the like, the substrate W is immersed, for example, in a CoWP plating solution at 80° C. for about 120 seconds to carry out electroless plating (electroless CoWP plating) selectively on surfaces of the activated interconnects 8. Thereafter, the surface of the substrate W is cleaned with a cleaning liquid such as pure water. Thus, a protective film 9 made of a CoWP alloy is formed selectively on the exposed surfaces of interconnects 8 so as to protect the interconnects 8.

When the protective film 9 is selectively formed on the exposed surfaces of the interconnects 8, as shown in FIG. 1, abnormal deposits 10, each having a size of several tens nm, are formed on the surface of the insulating film 2 other than the interconnects 8 due to metal particles and foreign matter attached to the surface of the insulating film 2 by the CMP process and trapped into the electroless plating solution, and catalytic metal released into the electroless plating solution. The abnormal deposits 10 may be removed by post-CMP cleaning, pre-electroless plating cleaning, or modifying the insulating film. Improving the selectivity by post-CMP cleaning or pre-electroless plating cleaning depends on a chemical process using a chemical solution of acid or alkali. However, the chemical process is not sufficiently effective to remove contaminants of those types that are not predicted by the chemical solution. Therefore, it is difficult to prevent contaminants that have not been removed by the chemical solution from being trapped into the electroless plating solution, and attached to the insulating film to produce abnormal deposits on the insulating film.

When abnormal deposits are produced on the insulating film other than the interconnects, the ability of the protective film covering the surfaces of the interconnects to prevent copper from being diffused is lowered, and the insulating film positioned between the interconnects is unable to provide a highly reliable insulation between the interconnects. Furthermore, the contaminants, which have not been removed by the chemical solution and which have been trapped into the electroless plating solution, and the catalytic metal released into the electroless plating solution change the properties of the electroless plating solution, tending to make plating reactions unstable.

SUMMARY OF THE INVENTION

The present invention has been made in view of the above situation in the related art. It is therefore an object of the present invention to provide an electroless plating apparatus and an electroless plating method for producing a protective film on exposed surfaces of embedded interconnects stably with good selectivity for thereby protecting the interconnects.

In order to achieve the above object, the present invention provides an electroless plating apparatus comprising a magnetic removal portion for magnetically removing small magnetic suspended solids in an electroless plating solution which have not been removed by a filter.

This can remove from the electroless plating solution small magnetic suspended solids having a size of several tens nm or less, e.g., magnetic contaminants which have not been removed by a chemical solution but have been trapped in the electroless plating solution, and a catalytic metal released into the electroless plating solution. Therefore, the small magnetic suspended solids in the electroless plating solution are prevented from being deposited on the surface of an insulating film or the like and from producing abnormal precipitates, and the properties of the electroless plating solution are rendered constant for a stable plating reaction.

In a preferred aspect of the present invention, the magnetic removal portion comprises a full-flow magnet filter filled with a number of magnets, for allowing the electroless plating solution to flow in its entirety through the magnet filter.

The electroless plating solution is brought in its entirety into contact with the magnets of the magnet filter. This can magnetically remove the small magnetic suspended solids in the electroless plating solution.

In a preferred aspect of the present invention, the magnet filter comprises a removable cartridge with the magnets disposed therein and a housing surrounding the cartridge in a liquid-tight manner, the magnetic filter being arranged such that the electroless plating solution flows into a space between the cartridge and the housing, then flows into the cartridge, and is discharged out of the cartridge.

A chemical solution, e.g., a solution of nitric acid in the range from 1 to 20% or preferably from 3 to 10% at 50° C. or preferably 60° C. or higher, is passed through the magnet filter, or the magnets together with the cartridge are immersed in the chemical solution for a predetermined period of time, thereby dissolving away the deposits on the magnets.

The cartridge may comprise a cylindrical cartridge casing, a cartridge cover having a plurality of solution inlet holes defined therein, and a cartridge seat plate having a plurality of solution outlet slots defined therein.

The electroless plating solution in its entirety flows through the solution inlet holes in a dispersed state into the cartridge casing. After having been in contact with the magnets in the cartridge casing, the electroless plating solution is discharged out of the cartridge casing though the solution outlet slits.

In a preferred aspect of the present invention, a metal or a metal compound on which an electroless plating reaction can take place is placed in the electroless plating solution.

While attracting the magnetic suspended solids under the magnetic forces from the magnetic removal portion, the electroless plating reaction can be taken place at the surface of the metal or the metal compound and the magnetic suspended solids can be removed (recovered).

The present invention provides another electroless plating apparatus comprising a plating tank for performing an electroless plating process therein, a plating solution reservoir tank free of corners, for storing an electroless plating solution therein, and a plating solution circulating system for circulating the electroless plating solution between the plating tank and the plating solution reservoir, with no stagnation in the circulating flow of the electroless plating solution.

Since the electroless plating solution is circulated at all times with no stagnation in its circulating flow, the plated metal once precipitated in the electroless plating solution is not redissolved into the electroless plating solution, and is hence prevented from being generated as precipitates. Consequently, the electroless plating solution is prevented from being modified.

The electroless plating apparatus may be designed to form a plated film of a cobalt alloy or a nickel alloy.

Therefore, a plated film made of a magnetic material such as a cobalt alloy or a nickel alloy may be selectively formed on exposed surfaces of embedded interconnects, for example, to protect the interconnects.

The present invention provides an electroless plating method comprising magnetically removing small magnetic suspended solids in an electroless plating solution which have not been removed by a filter, and bringing the electroless plating solution into contact with a surface of a substrate to plate a film on the surface of the substrate.

In a preferred aspect of the present invention, magnetically removing small magnetic suspended solids comprises bringing the electroless plating solution into contact with magnets disposed in a removable cartridge to magnetically remove the small magnetic suspended solids in the electroless plating solution.

In a preferred aspect of the present invention, the electroless plating method further comprises passing the magnets in a chemical solution or immersing the magnets together with the cartridge in a chemical solution to dissolve away the small magnetic suspended solids attracted as deposits to the magnets.

In a preferred aspect of the present invention, the electroless plating method further comprises placing a metal or a metal compound on which an electroless plating reaction can take place in the electroless plating solution, and applying a magnetic field to the metal or the metal compound.

While attracting the magnetic suspended solids under the magnetic forces, the electroless plating reaction can take place at the surface of the metal or the metal compound and the magnetic suspended solids can be removed (recovered). The surface area of the suspended solids attracted to the metal or the metal compound can be reduced by agglomeration. The surface area of the suspended solids attracted to the metal or the metal compound can further be reduced when it is made smooth by the electroless plating process. Accordingly, a constant area for collecting suspended solids may be provided.

The present invention provides another electroless plating method comprising circulating an electroless plating solution constantly with no stagnation in a circulating flow thereof, and bringing the electroless plating solution in contact with a surface of a substrate to plate a film on the surface of the substrate.

The electroless plating method may be designed to form a plated film of a cobalt alloy or a nickel alloy.

According to the present invention, the small magnetic suspended solids in the electroless plating solution are prevented from being deposited on a surface of an insulating film or the like and from producing abnormal precipitates thereon. The properties of the electroless plating solution are rendered constant for a stable plating reaction. Consequently, a protective film (plated film) can be formed stably with good selectivity on exposed surfaces of interconnects.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
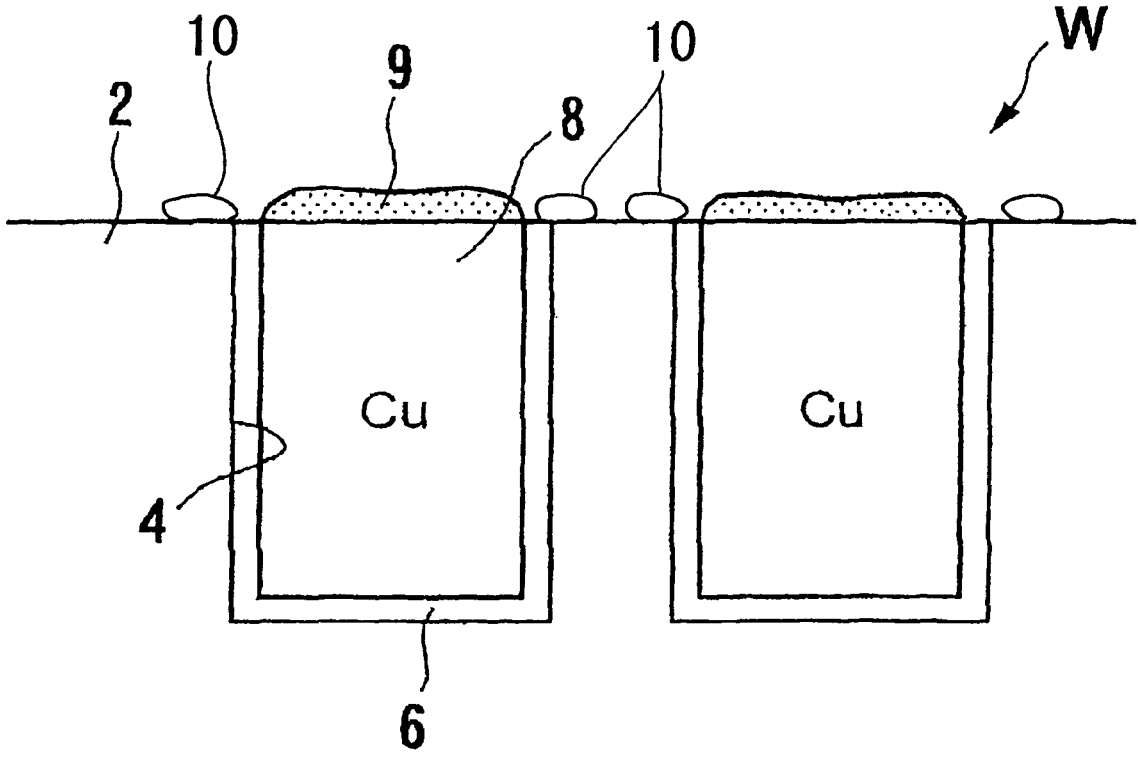
FIG. 1 is a cross-sectional view showing a state in which a protective film for protecting interconnects is formed by electroless plating.

Preferred embodiments of the present invention will now be described with reference to the drawings. The following description illustrates a case of selectively covering exposed surfaces of interconnects 8 with a protective film (cap material) 9 of a CoWP alloy to protect interconnects 8, as shown in FIG. 1. The present invention may also be adapted to cover a surface of copper, silver or the like with a metal film by depositing the metal film (plated film) of a Co alloy, a Ni alloy or the like.

Figure 2:
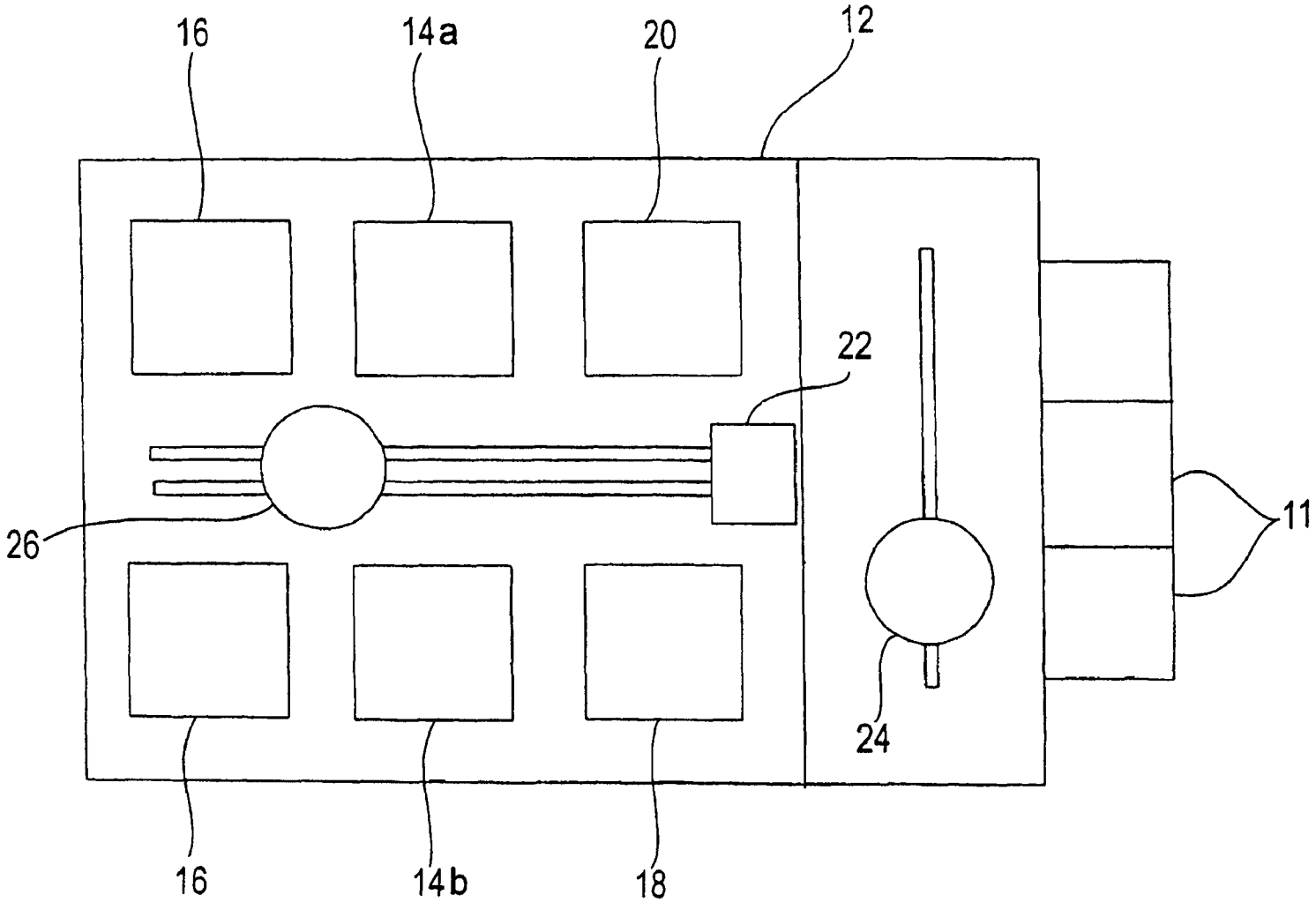
FIG. 2 is a layout plan view of a substrate processing apparatus incorporating an electroless plating apparatus according to an embodiment of the present invention.

FIG. 2 is a layout plan view of a substrate processing apparatus incorporating an electroless plating apparatus according to an embodiment of the present invention. As shown in FIG. 2, the substrate processing apparatus is provided with loading/unloading units 11 each for mounting substrate cassettes which accommodate a number of substrates W, such as semiconductor wafers, having interconnects 8 of, e.g., copper on the surfaces. Inside of a rectangular apparatus frame 12 having an air discharge system, there are disposed a first pre-processing apparatus 14*a* for cleaning a surface of the substrate W with a cleaning liquid, and a second pre-processing apparatus 14*b* for imparting a catalyst, such as Pd, to a cleaned surface of the substrate. The first pre-processing apparatus 14*a* and the second pre-processing apparatus 14*b* use different processing liquids (chemical solutions) but have the same structure.

Inside of the apparatus frame 12, there are disposed two electroless plating apparatuses 16 for performing electroless plating onto a surface (surface to be processed) of the substrate W, a post-processing apparatus 18 for performing post-plating processing of the substrate W after the plating to improve the selectivity of a protective film (metal film) 9 formed on surfaces of interconnects 8 by electroless plating, a drying apparatus 20 for drying the substrate W after the post-processing, and a temporary storage table 22. Furthermore, inside of the apparatus frame 12, there are disposed a movable first substrate transport robot 24 for transferring a substrate between the substrate cassette set in the loading/unloading unit 11 and the temporary storage table 22, and a moveable second substrate transport robot 26 for transferring a substrate between the temporary storage table 22 and each of the apparatuses 14*a*, 14*b*, 16, 18, and 20.

Next, there will be described below the details of various apparatuses provided in the substrate processing apparatus shown in FIG. 2.

The pre-processing apparatus 14*a* (14*b*) employs a two-liquid separation system to prevent the different liquids from being mixed with each other. While a peripheral portion of a lower surface of the substrate W, which is a surface to be processed (front face), transferred in a face-down manner is sealed, the substrate W is fixed by pressing a rear face of the substrate.

As shown in FIGS. 3 through 6, the pre-processing apparatus 14*a* (14*b*) includes a fixed frame 52 that is mounted on the upper part of a frame 50, and a movable frame 54 that moves up and down relative to the fixed frame 52. A processing head 60, which includes a bottomed cylindrical housing portion 56, opening downwardly, and a substrate holder 58, is suspended from and supported by the movable frame 54. In particular, a head-rotating servomotor 62 is mounted to the movable frame 54, and the housing portion 56 of the processing head 60 is coupled to the lower end of the downward-extending output shaft (hollow shaft) 64 of the servomotor 62.

Figure 6:
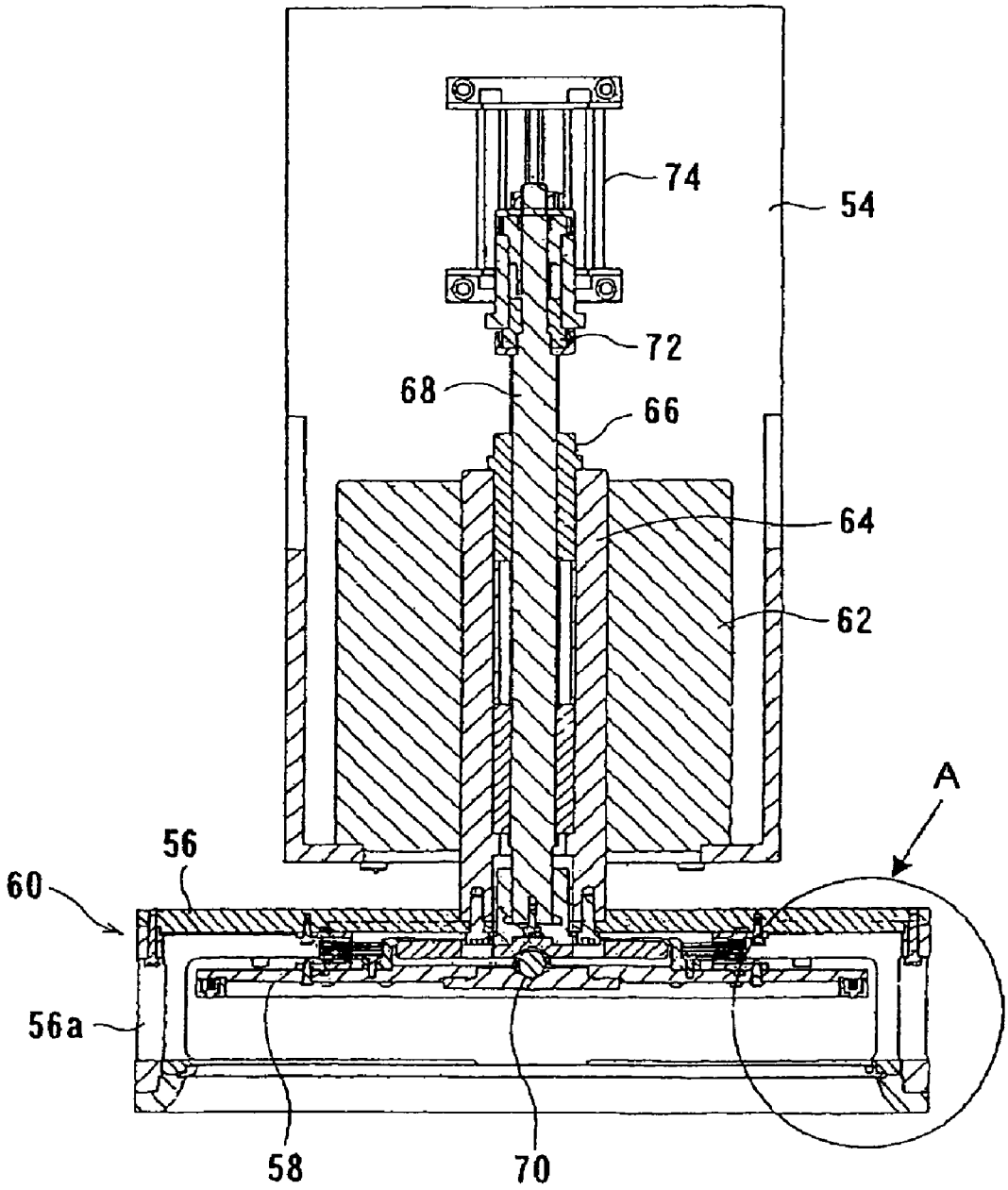
FIG. 6 is a cross-sectional view showing a processing head of the pre-processing apparatus at the time of substrate delivery.

As shown in FIG. 6, a vertical shaft 68, which rotates together with the output shaft 64 via a spline 66, is inserted in the output shaft 64, and the substrate holder 58 of the processing head 60 is coupled to the lower end of the vertical shaft 68 via a ball joint 70. The substrate holder 58 is positioned within the housing portion 56. The upper end of the vertical shaft 68 is coupled via a bearing 72 and a bracket to a fixed ring-elevating cylinder 74 secured to the movable frame 54. Thus, by the actuation of the cylinder 74, the vertical shaft 68 moves vertically independently of the output shaft 64.

Linear guides 76, which extend vertically and guide vertical movement of the movable frame 54, are mounted to the fixed frame 52, so that by the actuation of a head-elevating cylinder (not shown), the movable frame 54 moves vertically by the guide of the linear guides 76.

Figure 7:
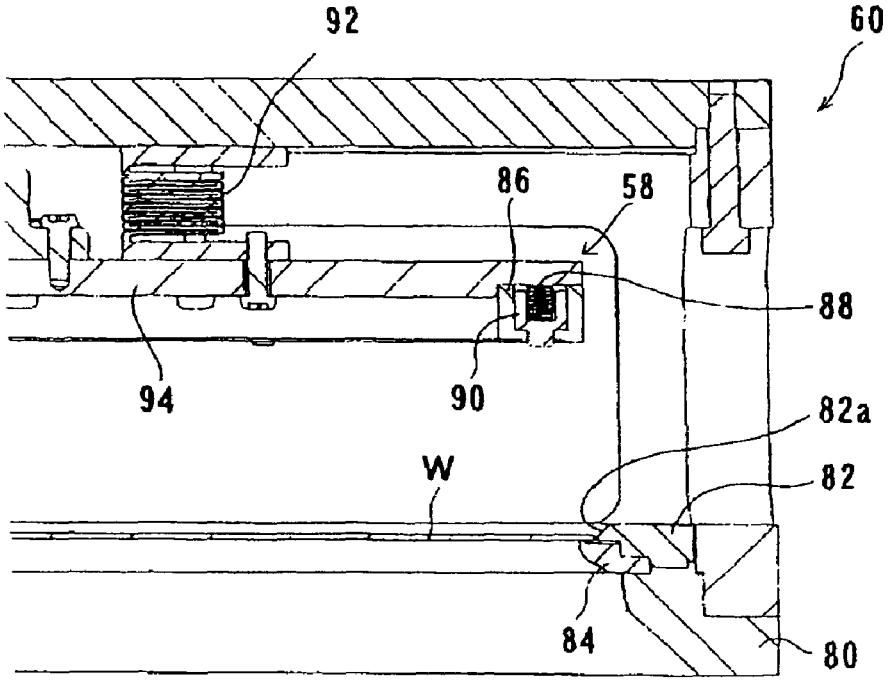
FIG. 7 is an enlarged view of a portion A of FIG. 6.
Figure 8:
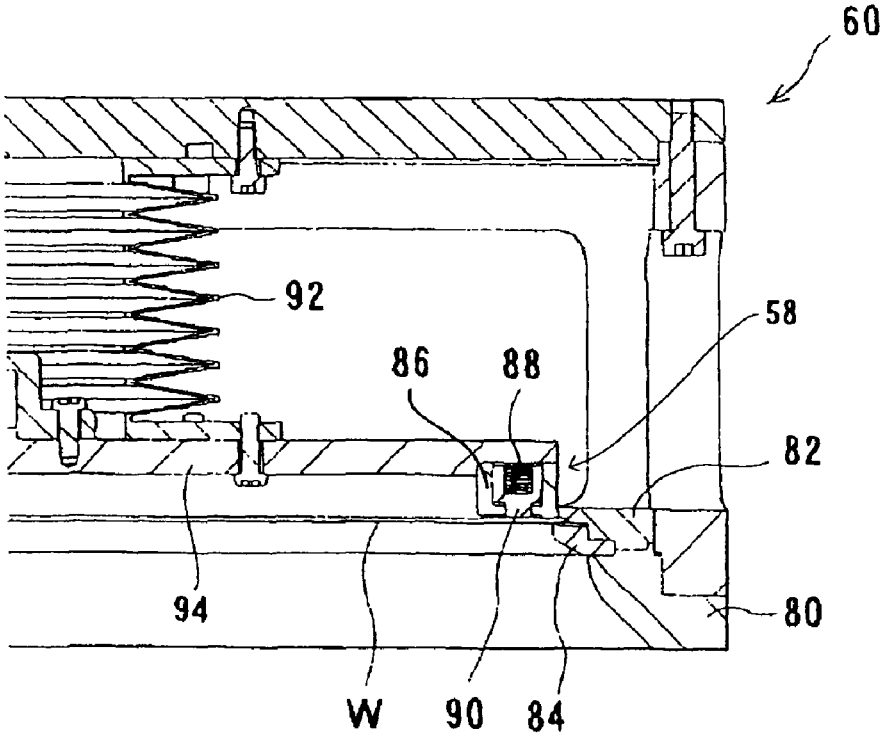
FIG. 8 is a view of the pre-processing apparatus when the substrate is fixed, which corresponds to FIG. 7.

Substrate insertion windows 56*a* for inserting the substrate W into the housing portion 56 are formed in the circumferential wall of the housing portion 56 of the processing head 60. Further, as shown in FIGS. 7 and 8, a seal ring 84 is provided in the lower portion of the housing portion 56 of the processing head 60, an outer peripheral portion of the seal ring 84 being sandwiched between a main frame 80 made of, e.g., PEEK and a guide frame 82 made of, e.g., polyethylene. The seal ring 84 is arranged to make contact with a peripheral portion of the lower surface of the substrate W to seal the peripheral portion.

A substrate fixing ring 86 is fixed to a peripheral portion of the lower surface of the substrate holder 58. Columnar pushers 90 each protrudes downwardly from the lower surface of the substrate fixing ring 86 by the elastic force of a spring 88 disposed within the substrate fixing ring 86 of the substrate holder 58. Further, a flexible cylindrical bellows-like plate 92 made of, e.g., Teflon (registered trademark) is disposed between the upper surface of the substrate holder 58 and the upper wall of the housing portion 56 to hermetically seal therein. Further, the substrate holder 58 is provided with a covering plate 94 for covering an upper surface of the substrate held by the substrate holder 58.

When the substrate holder 58 is in a raised position, a substrate W is inserted from the substrate insertion window 56*a* into the housing portion 56. The substrate W is then guided by a tapered surface 82*a* provided in the inner circumferential surface of the guide frame 82, and positioned and placed at a predetermined position on the upper surface of the seal ring 84. In this state, the substrate holder 58 is lowered so as to bring the pushers 90 of the substrate fixing ring 86 into contact with the upper surface of the substrate W. The substrate holder 58 is further lowered so as to press the substrate W downwardly by the elastic forces of the springs 88, thereby forcing the seal ring 84 to make pressure contact with a peripheral portion of the front surface (lower surface) of the substrate W to seal the peripheral portion while nipping the substrate W between the housing portion 56 and the substrate holder 58 to hold the substrate W.

When the head-rotating servomotor 62 is driven while the substrate W is thus held by the substrate holder 58, the output shaft 64 and the vertical shaft 68 inserted in the output shaft 64 rotate together via the spline 66, whereby the substrate holder 58 rotates together with the housing portion 56.

At a position below the processing head 60, there is provided an upward-open processing tank 100 (see FIG. 9) comprising an outer tank 100*a* and an inner tank 100*b* which have a slightly larger inner diameter than the outer diameter of the processing head 60. A pair of leg portions 104, which are mounted to a lid 102, are rotatably supported on the outer circumferential portion of the inner tank 100*b*. Further, a crank 106 is integrally coupled to each leg portion 104, and the free end of the crank 106 is rotatably coupled to the rod 110 of a lid-moving cylinder 108. Thus, by the actuation of the lid-moving cylinder 108, the lid 102 moves between a processing position at which the lid 102 covers the top opening of the inner tank 100*b* and a retreat position beside the inner tank 100*b*. In the surface (upper surface) of the lid 102, there is provided a nozzle plate 112 having a large number of ejection nozzles 112*a* for ejecting, e.g., pure water outwardly (upwardly).

Figure 9:
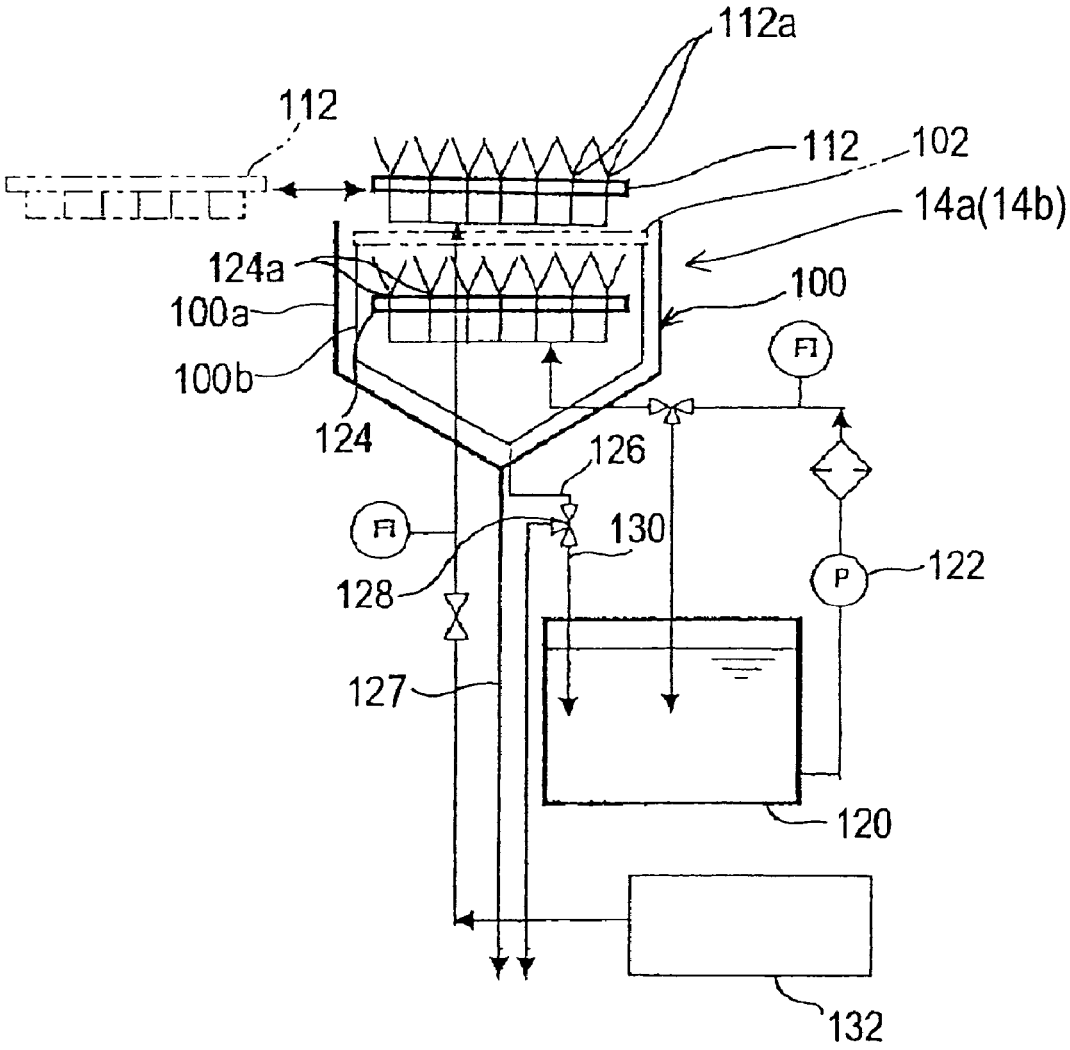
FIG. 9 is a system diagram of the pre-processing apparatus.

Further, as shown in FIG. 9, a nozzle plate 124 having a plurality of ejection nozzles 124*a* for ejecting upwardly a processing liquid supplied from a processing liquid tank 120 by driving a processing liquid pump 122 is provided in the inner tank 100*b* of the processing tank 100 in such a manner that the ejection nozzles 124*a* are equally distributed over the entire surface of the cross section of the inner tank 100*b*. A drainpipe 126 for draining a processing liquid (waste liquid) to the outside is connected to the bottom of the inner tank 100*b*. A three-way valve 128 is provided in the drainpipe 126 and the processing liquid (waste liquid) is returned to the processing liquid tank 120 through a return pipe 130 connected to one of outlet ports of the three-way valve 128 so as to reuse the processing liquid (waste liquid), as needed.

The first pre-processing apparatus 14*a* uses as a processing liquid a cleaning liquid comprising an inorganic acid such as HF, $H_2SO_4$, HCl, or the like, an organic acid such as oxalic acid, citric acid, or the like, or a mixture of such acids. In the first pre-processing apparatus 14*a*, the processing liquid (cleaning liquid) is ejected toward the surface of the substrate to remove an oxide film on the surfaces of the interconnects 8 for thereby activating the surfaces, and simultaneously to remove CMP residuals such as copper remaining on the surface of the insulating film 2 for thereby preventing a metal film from being formed on the surface of the insulating film 2. The amount of oxygen dissolved in the processing liquid should preferably be 3 ppm or smaller for preventing the surface of the substrate from being oxidized by oxygen included in the processing liquid and hence preventing the electrical properties of the activated interconnects from being adversely affected by oxidization.

The second pre-processing apparatus 14*b* uses as a processing liquid a catalyst imparting solution including at least a catalytic metal salt and a pH adjustment agent. The amount of oxygen dissolved in the catalyst imparting solution (processing liquid) should preferably be 3 ppm or smaller. The catalytic metal salt is contained in a range from 0.005 to 10 g/L, for example, in the catalyst imparting solution (processing liquid). The catalytic metal in the catalytic metal salt comprises at least one of Pd, Pt, Ru, Co, Ni, Au, and Ag, for example. It is preferable to use Pd as the catalytic metal for its reaction rate and better controllability.

The pH adjustment agent comprises an acid selected from hydrochloric acid, sulfuric acid, nitric acid, citric acid, oxalic acid, formic acid, acetic acid, maleic acid, malic acid, adipic acid, pimelic acid, glutaric acid, succinic acid, fumaric acid, and phthalic acid, or a base selected from an aqueous ammonia solution, KOH, tetramethylammonium hydride, and tetraethylammonium hydride. The pH of the catalyst imparting solution (processing liquid) is adjusted to a target value ±0.2 in the range from 0 to 6, for example, by the pH adjustment agent.

In this embodiment, the nozzle plate 112 mounted on the surface (upper surface) of the lid 102 is connected to a rinsing liquid supply source 132 which supplies a rinsing liquid such as pure water or the like. The rinsing liquid (pure water) with the amount of dissolved oxygen being 3 ppm or lower is ejected from the nozzle plate 112 toward the surface of the substrate. A drain pipe 127 is connected to the bottom of the outer tank 100*a*.

The processing head 60, which holds the substrate, is lowered until the processing head 60 covers the opening in the upper end of the inner tank 100*b* of the processing tank 100. Then, the processing liquid, i.e., the cleaning liquid in the first pre-processing apparatus 14*a* or the catalyst imparting solution in the second pre-processing apparatus 14*b*, is ejected from the ejection nozzles 124*a* of the nozzle plate 124 disposed in the inner tank 100*b* uniformly to the entire lower surface (surface to be processed) of the substrate W. The processing liquid, which has been ejected, is prevented from being scattered around and is discharged outside through the drainpipe 126.

The processing head 60 is then elevated. With the opening in the upper end of the inner tank 100*b* being closed by the lid 102, the rinsing liquid is ejected from the ejection nozzles 112*a* of the nozzle plate 112 on the upper surface of the lid 102 to the substrate W held by the processing head 60, thereby rinsing off the processing liquid remaining on the surface of the substrate W. The rinsing liquid flows downwardly through the gap between the outer tank 100*a* and the inner tank 100*b* and is discharged through the drainpipe 127. The rinsing liquid is therefore prevented from flowing into the inner tank 100*b* and from being mixed with the processing liquid.

Figure 3:
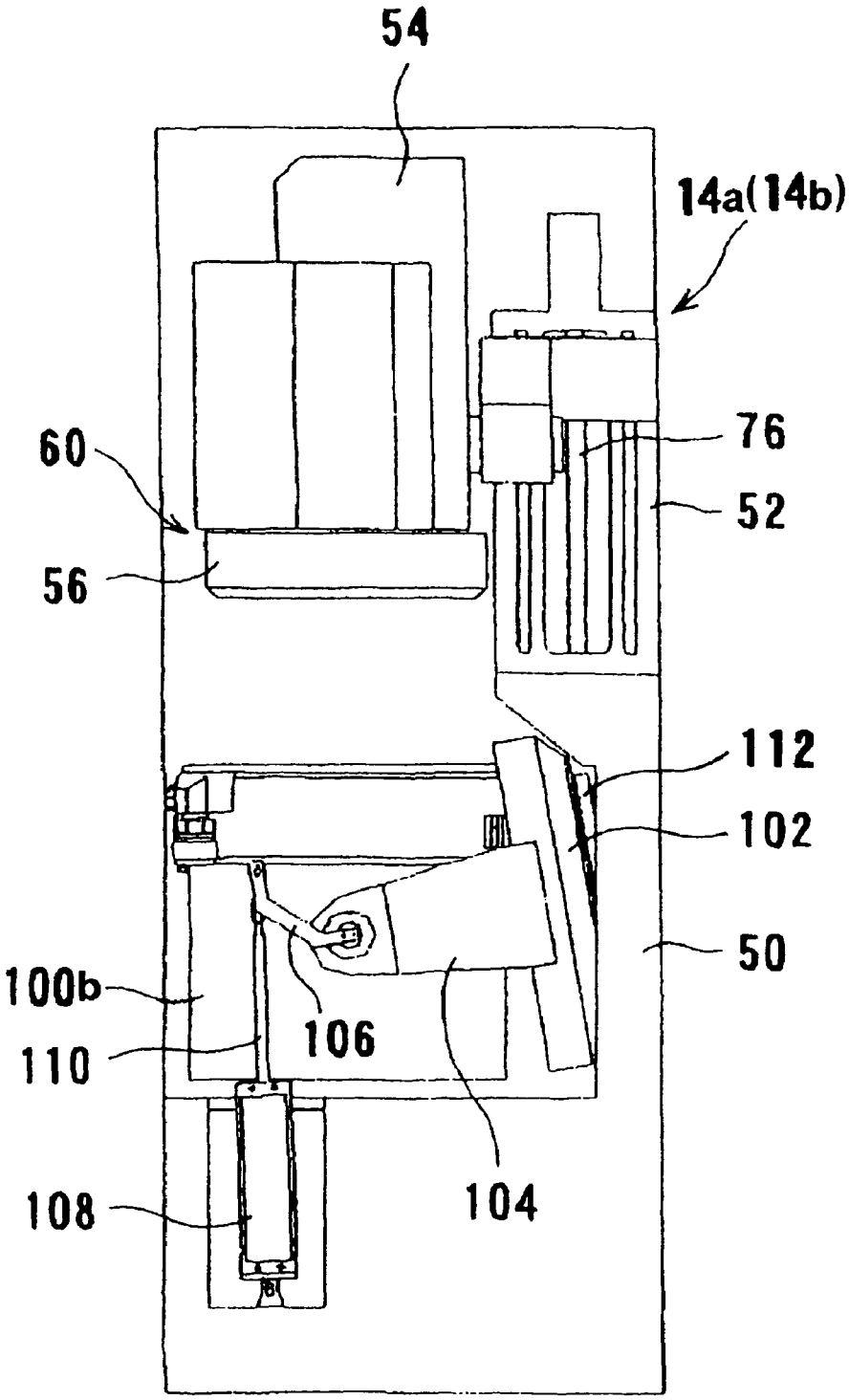
FIG. 3 is a front view of a pre-processing apparatus omitting an outer tank at the time of substrate delivery.
Figure 4:
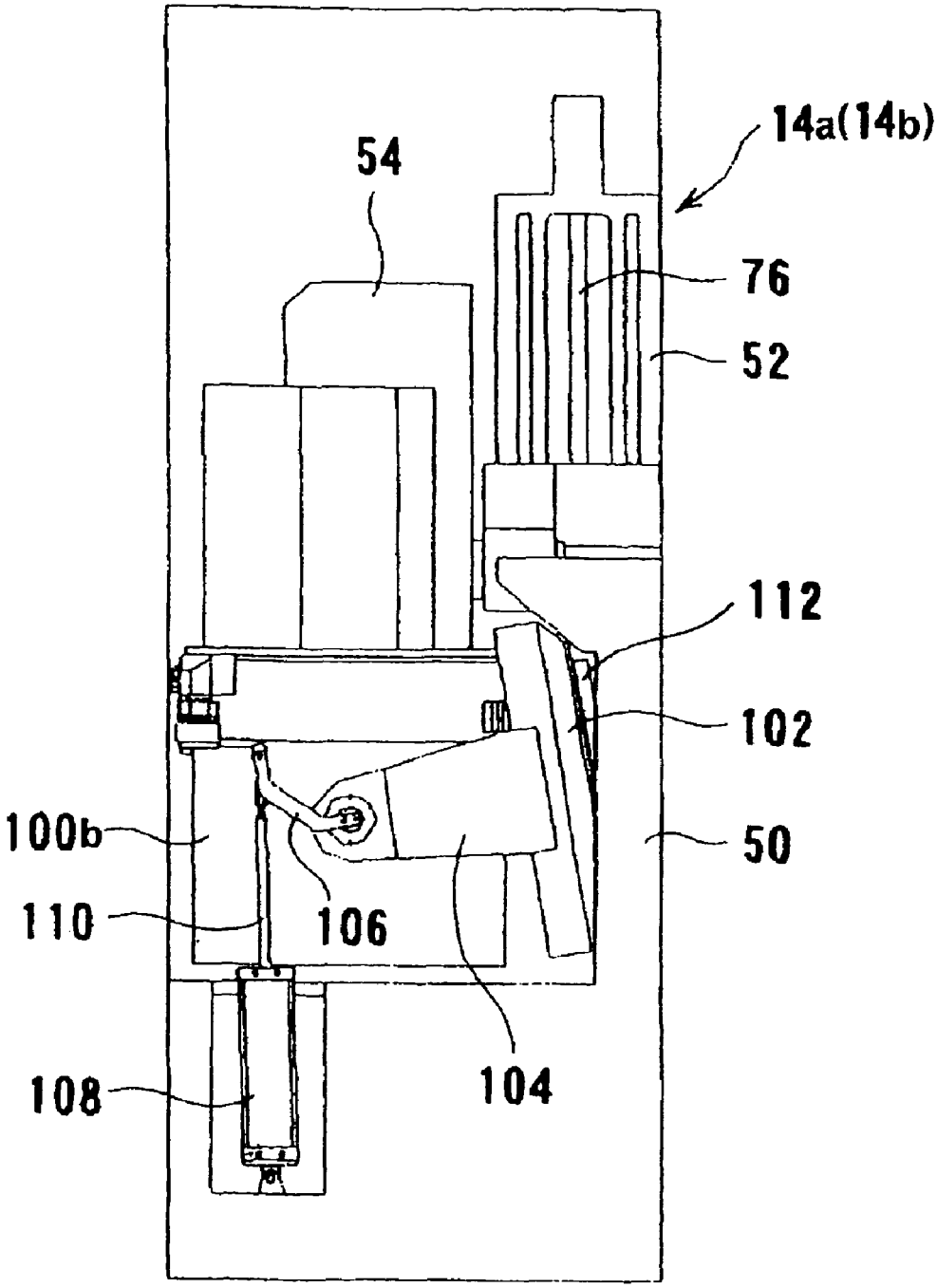
FIG. 4 is a front view of the pre-processing apparatus omitting the outer tank at the time of processing with a processing liquid.
Figure 5:
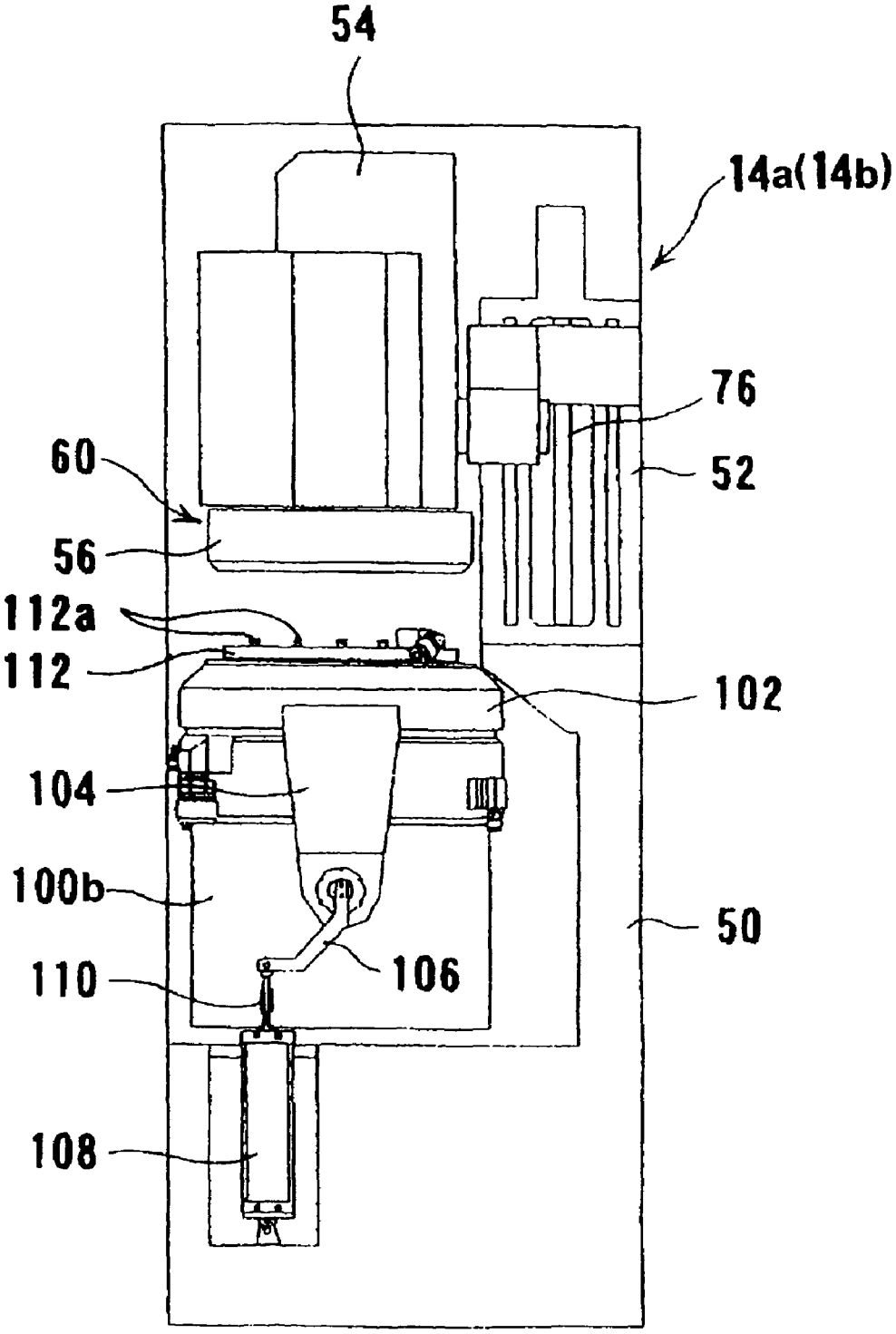
FIG. 5 is a front view of the pre-processing apparatus omitting the outer tank at the time of rinsing.

The pre-processing apparatuses 14*a*, 14*b* operate as follows: When the processing head 60 is elevated, as shown in FIG. 3, the substrate W is inserted into the processing head 60 and held thereby. Thereafter, as shown in FIG. 4, the processing head 60 is lowered until it is positioned to cover the opening in the upper end of the inner tank 100*b* of the processing tank 100. Then, while the processing head 60 is being rotated to rotate the substrate W held thereby, the cleaning liquid or the catalyst imparting solution is ejected from the ejection nozzles 124*a* of the nozzle plate 124 disposed in the inner tank 100*b* of the processing tank 100 uniformly to the entire lower surface of the substrate W. The processing head 60 is elevated to and stopped in a predetermined position, and, as shown in FIG. 5, the lid 102 is moved to a position in which it covers the opening in the upper end of the inner tank 100*b* of the processing tank 100. Then, the rinsing liquid is ejected from the ejection nozzles 112*a* of the nozzle plate 112 on the upper surface of the lid 102 to the substrate W held and rotated by the processing head 60. In this manner, the substrate W can be processed with the processing liquid and rinsed with the rinsing liquid such that the processing liquid and the rinsing liquid are not mixed with each other.

The electroless plating apparatus 16 is shown in FIGS. 10 through 16. The electroless plating apparatus 16 comprises a plating tank 200 (see FIGS. 14 and 16) and a substrate head 204, disposed above the plating tank 200, for holding the substrate W detachably.

Figure 10:
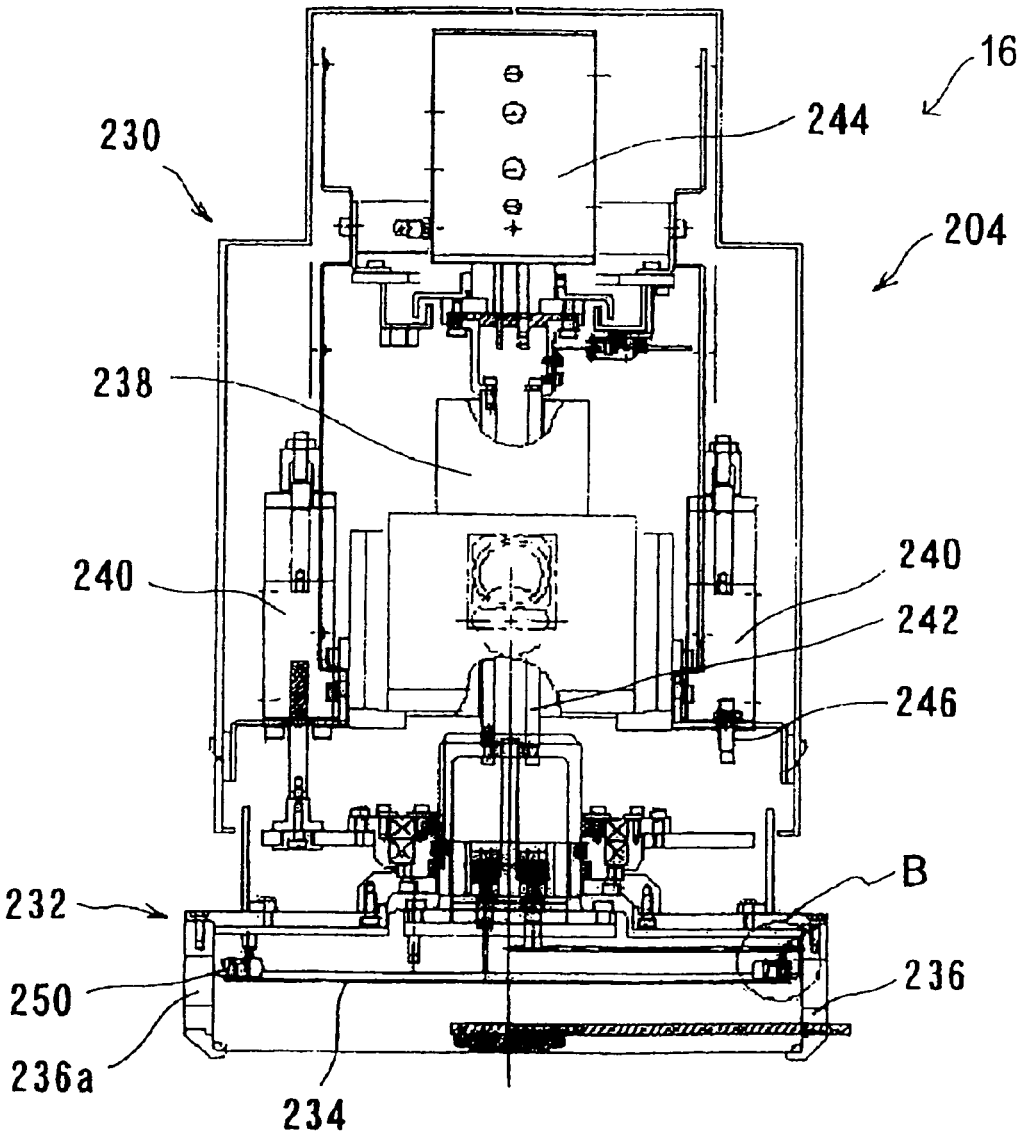
FIG. 10 is a cross-sectional view showing a substrate head of an electroless plating apparatus when a substrate is delivered.

As shown in detail in FIG. 10, the substrate head 204 comprises a housing portion 230 and a head portion 232. The head portion 232 mainly comprises a suction head 234 and a substrate receiver 236 disposed around the suction head 234. The housing portion 230 accommodates therein a substrate rotating motor 238 and substrate receiver driving cylinders 240. The substrate rotating motor 238 has a hollow output shaft 242 having an upper end coupled to a rotary joint 244 and a lower end coupled to the suction head 234. The substrate receiver driving cylinders 240 have respective rods coupled to the substrate receiver 236. Stoppers 246 for mechanically limiting the substrate receiver 236 against upward movement are disposed in the housing portion 230.

A splined structure is provided between the suction head 234 and the substrate receiver 236. The substrate receiver 236 is vertically moved relative to the suction head 234 by the actuation of the substrate receiver driving cylinders 240. When the substrate rotating motor 238 is driven to rotate the output shaft 242, the suction head 234 and the substrate receiver 236 are rotated in unison with each other according to the rotation of the output shaft 242.

Figure 11:
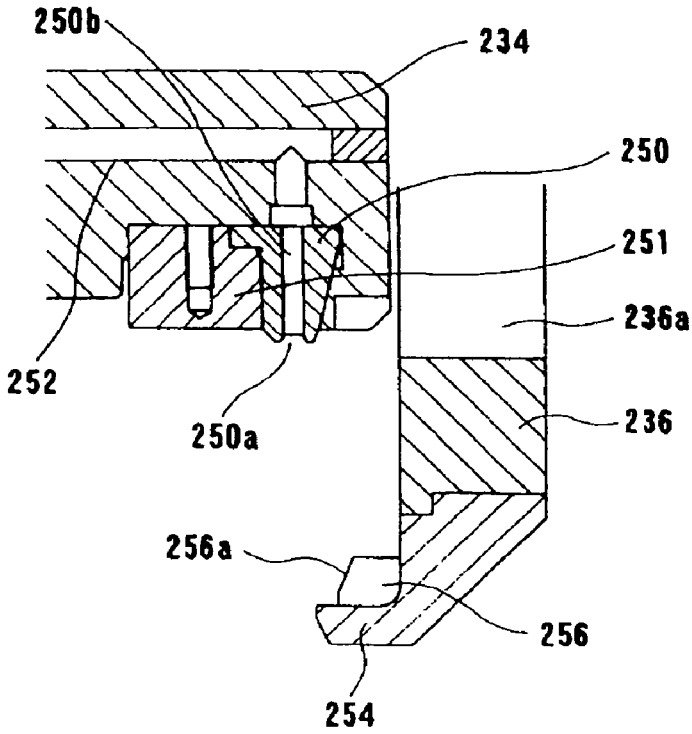
FIG. 11 is an enlarged view of a portion B of FIG. 10.
Figure 12:
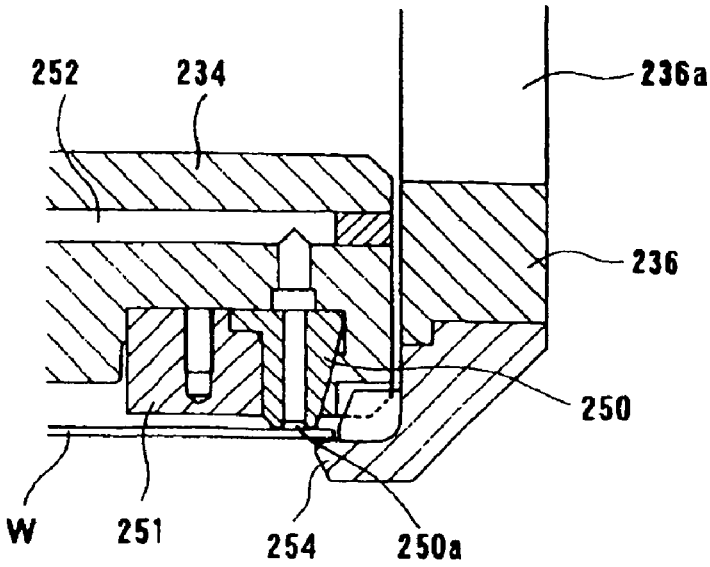
FIG. 12 is a view of the substrate head of the electroless plating apparatus when the substrate is fixed, which corresponds to FIG. 11.
Figure 13:
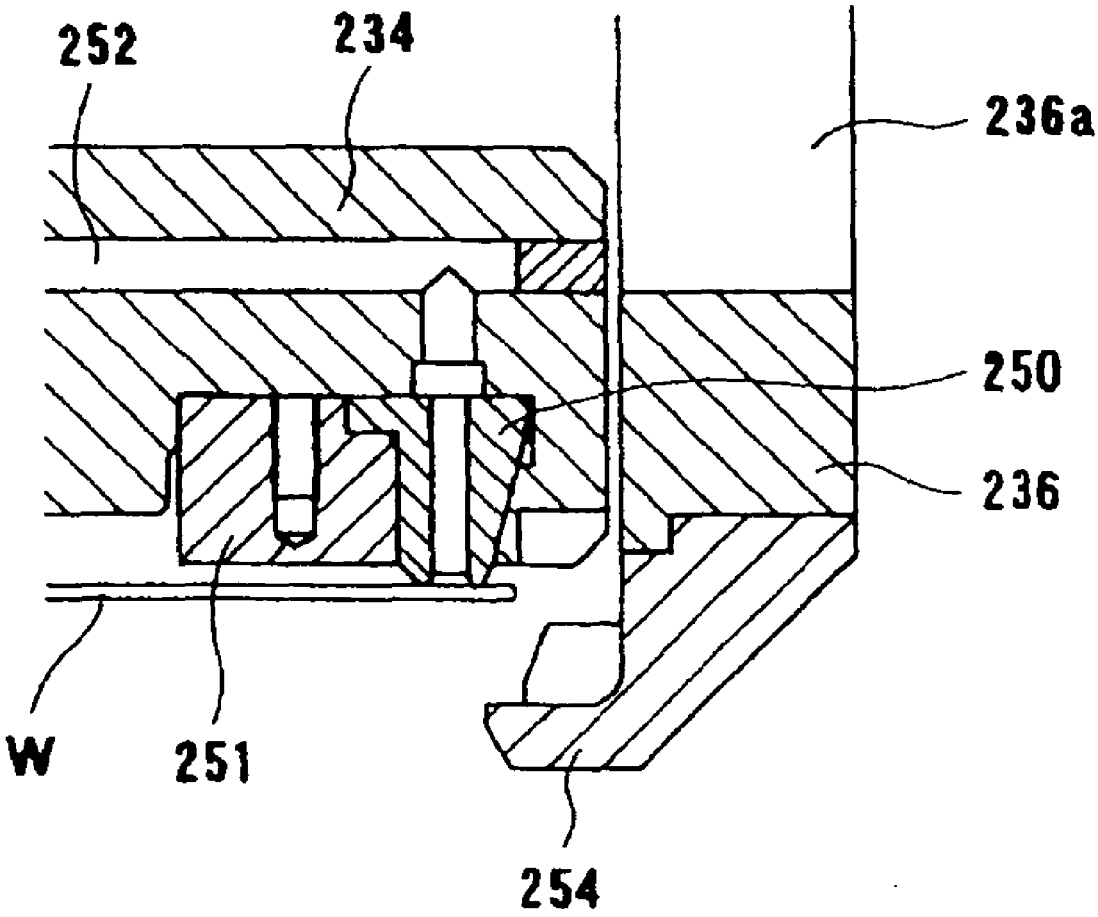
FIG. 13 is a view of the substrate head of the electroless plating apparatus at the time of plating, which corresponds to FIG. 11.

As shown in detail in FIGS. 11 through 13, a suction ring 250, for attracting and holding a substrate W against its lower surface to be sealed, is mounted on a lower circumferential edge of the suction head 234 by a presser ring 251. A recess 250*a* continuously defined in a lower surface of the suction ring 250 in a circumferential direction communicates with a vacuum line 252 extending inside of the suction head 234 via a communication hole 250*b* defined in the suction ring 250. By evacuating the recess 250*a*, the substrate W is attracted and held. Thus, the substrate W is attracted and held under vacuum along a (radially) narrow circumferential area. Accordingly, it is possible to minimize any adverse effects (flexing or the like) caused by the vacuum on the substrate W. Further, when the suction ring 250 is immersed in the electroless plating solution, all portions of the substrate W including not only the front face (lower surface) of the substrate W, but also its circumferential edge can be immersed in the electroless plating solution. The substrate W is released by supplying $N_2$ into the vacuum line 252.

Meanwhile, the substrate receiver 236 is in the form of a bottomed cylinder opened downward. Substrate insertion windows 236*a* for inserting the substrate W into the substrate receiver 236 are defined in a circumferential wall of the substrate receiver 236. A disk-like ledge 254 projecting inward is provided at a lower end of the substrate receiver 236. Protrusions 256 having an inner tapered surface 256*a* for guiding the substrate W are provided on an upper portion of the ledge 254.

As shown in FIG. 11, when the substrate receiver 236 is in a lowered position, the substrate W is inserted through the substrate insertion window 236*a* into the substrate receiver 236. The substrate W is then guided by the tapered surfaces 256*a* of the protrusions 256 and positioned and placed at a predetermined position on an upper surface of the ledge 254 of the substrate receiver 236. In this state, as shown in FIG. 12, the substrate receiver 236 is lifted up so as to bring the upper surface of the substrate W placed on the ledge 254 of the substrate receiver 236 into abutment against the suction ring 250 of the suction head 234. Then, the recess 250*a* in the vacuum ring 250 is evacuated through the vacuum line 252 to attract and hold the substrate W while sealing the upper peripheral edge of the substrate W against the lower surface of the suction ring 250. For performing an electroless plating process, as shown in FIG. 13, the substrate receiver 236 is lowered several millimeters to space the substrate W from the ledge 254 so that the substrate W is attracted and held only by the suction ring 250. Thus, it is possible to prevent the front face (lower surface) of the peripheral edge portion of the substrate W from not being plated because of the presence of the ledge 254.

Figure 14:
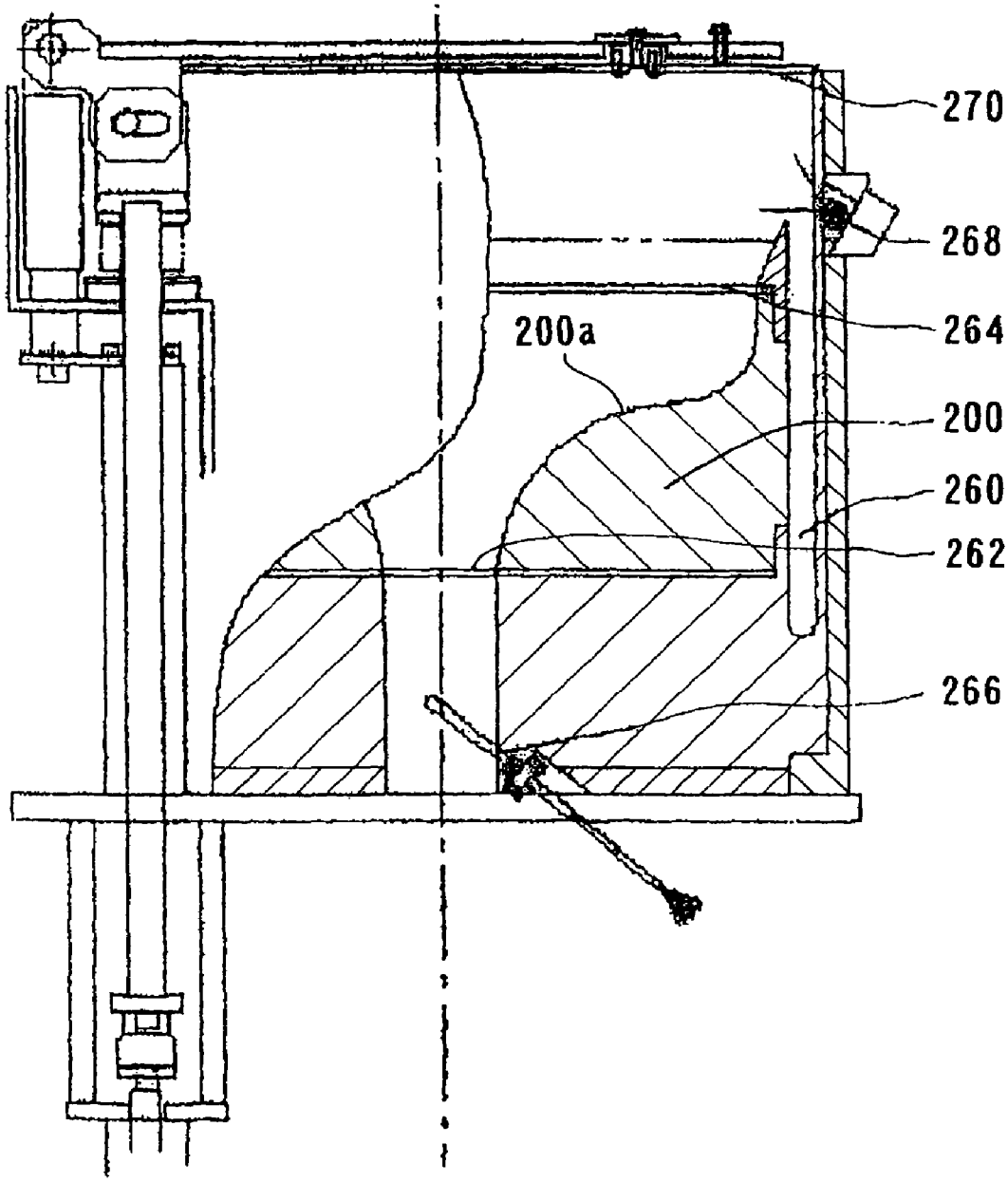
FIG. 14 is a front view showing, in a partially cutaway manner, a plating tank of the electroless plating apparatus when a plating tank cover is closed.

FIG. 14 shows the details of the plating tank 200. The plating tank 200 is connected at the bottom to a plating solution supply pipe 308 (see FIG. 16) and is provided in the peripheral wall with a plating solution recovery gutter 260. In the plating tank 200, there are disposed two current plates 262, 264 for stabilizing the flow of an electroless plating solution flowing upward. A thermometer 266, for measuring the temperature of the electroless plating solution to be introduced into the plating tank 200, is disposed at the bottom of the plating tank 200. Further, on the outer surface of the peripheral wall of the plating tank 200 and at a position slightly higher than the liquid level of the electroless plating solution held in the plating tank 200, there is provided an ejection nozzle 268 for ejecting a stop liquid which is a neutral liquid having a pH of 6 to 7.5, for example, pure water, slightly upward with respect to a diametrical direction in the plating tank 200. After the electroless plating, the substrate W held by the head portion 232 is lifted up and stopped at a position slightly above the liquid level of the electroless plating solution. In this state, pure water (stop liquid) is ejected from the ejection nozzle 268 toward the substrate W to cool the substrate W immediately, thereby preventing progress of electroless plating by the electroless plating solution remaining on the substrate W.

The plating tank 200 has a funnel-shaped corner-free inner circumferential surface 200*a* whose cross-sectional area progressively increases upwardly. The electroless plating solution that is supplied to the plating tank 200 flows smoothly upwardly along the funnel-shaped inner circumferential surface 200*a* with no stagnation in its flow.

A plating tank cover 270 is openably and closably placed in the opening in the upper end of the plating tank 200. While no plating process is being performed in the plating tank 200, e.g., while the electroless plating apparatus is idling, the plating tank cover 270 closes the opening in the upper end of the plating tank 200 to prevent the electroless plating solution in the plating tank 200 from being evaporated and radiating its heat uselessly.

Figure 16:
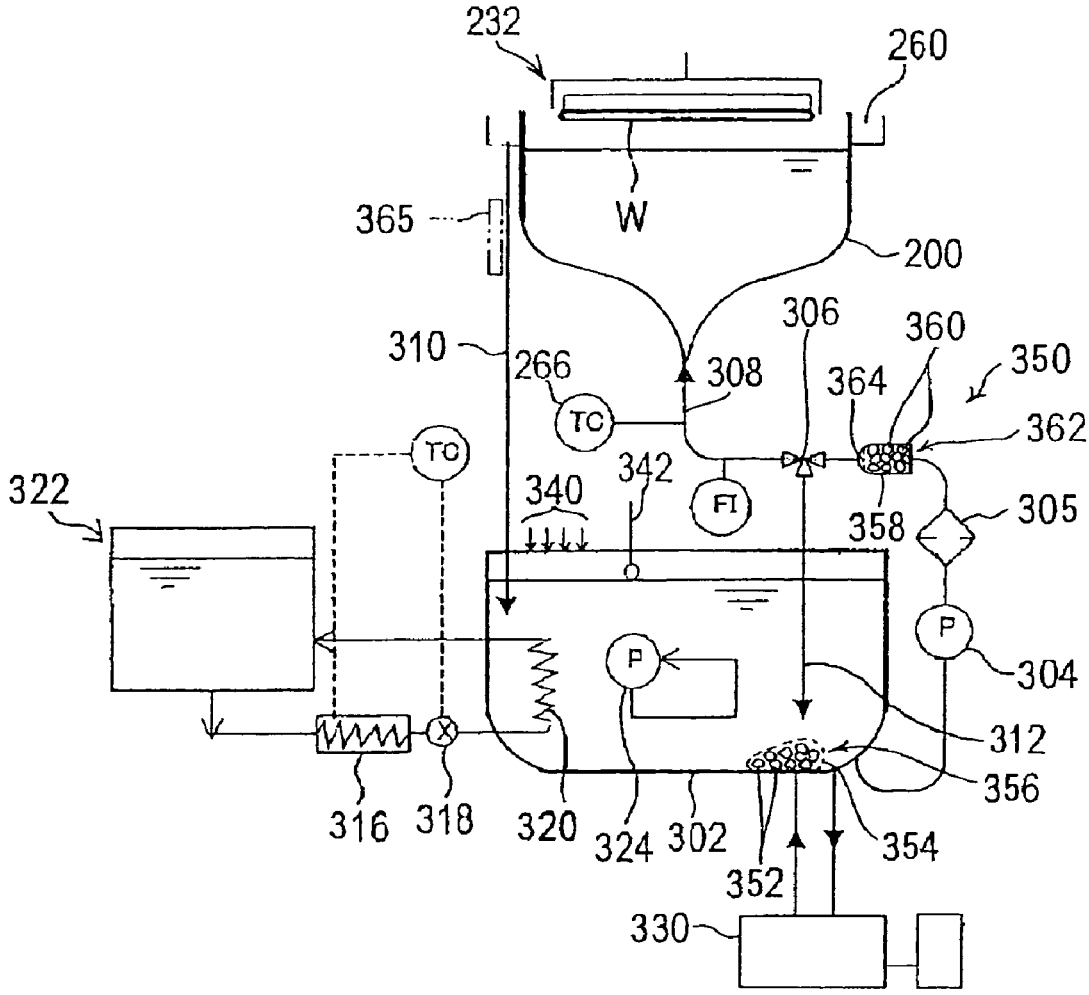
FIG. 16 is a system diagram of the electroless plating apparatus.

As shown in FIG. 16, the bottom of the plating tank 200 is connected to the plating solution supply pipe 308 extending from a plating solution reservoir tank 302 and having a plating solution supply pump 304, a filter 305, and a three-way valve 306. Further, the plating solution recovery gutter 260 is connected to a plating solution recovery pope 310 extending from the plating solution reservoir tank 302. Thus, during a plating process, an electroless plating solution is supplied from the bottom of the plating tank 200 into the plating tank 200, and an electroless plating solution, which has overflowed the plating tank 200, is recovered to the plating solution reservoir tank 302 by the plating solution recovery gutter 260 through the plating solution recovery pope 310. Thus, the electroless plating solution can be circulated. A plating solution return pipe 312 for returning the electroless plating solution to the plating solution reservoir tank 302 is connected to one of the ports of the three-way valve 306. Accordingly, the electroless plating solution can be circulated even at the time of a standby for plating. Thus, a plating solution circulating system 350 is constructed. As described above, the electroless plating solution in the plating solution reservoir tank 302 is continuously circulated through the plating solution circulating system 350 to thus control particles in the electroless plating solution by performing filtering.

Particularly, in this embodiment, by controlling the plating solution supply pump 304, the flow rate of the electroless plating solution circulated at the time of a standby of plating or a plating process can be set individually. Specifically, the amount of the electroless plating solution circulated at the time of the standby of plating is set to be in a range of 2 to 20 L/min, for example, and the amount of the electroless plating solution circulated at the time of the plating process is set to be in a range of 0 to 10 L/min, for example. Thus, a large amount of the electroless plating solution circulated at the time of the standby of plating can be ensured so as to maintain the temperature of a plating bath in a cell to be constant, and the amount of the electroless plating solution circulated at the time of the plating process is reduced so as to deposit a protective film (plated film) having a more uniform thickness.

The plating solution reservoir tank 302 is formed into a shape free of corners on side and bottom surfaces by drawing, i.e., a cylindrical pot in this embodiment. The plating solution supply pipe 308 comprises a straight pipe and a curved pipe connected to the straight pipe so as not to have elbow-like sharp bends. Likewise, the plating solution recovery pipe 310 also comprises a straight pipe and a curved pipe connected to the straight pipe so as not to have elbow-like sharp bends. In FIG. 16, the plating solution recovery pipe 310 is shown as being straight.

When the electroless plating solution flows along a plating solution circulating system 350 for circulation between the plating solution reservoir tank 302 and the plating tank 200, the electroless plating solution flows through the plating solution supply pipe 308, the plating solution recovery pipe 310, the plating solution reservoir tank 302, and the plating tank 200, with no stagnation in its flow. Even when no plating process is performed, the electroless plating solution in the plating solution reservoir tank 302 can be circulated.

The electroless plating solution has both a power to be precipitated by self-decomposition and a power to ionize precipitates which have been reduced and metalized. When the electroless plating solution is circulated at all times with no stagnation in its flow throughout the entire system, the power to redissolve the precipitated plated metal in stagnated flows is reduced, thereby preventing precipitates from being generated.

A first magnetic removal portion 356 is disposed in a position immersed by the electroless plating solution in the plating solution reservoir tank 302. The first magnetic removal portion 356 comprises, for example, a bundle of permanent magnets 352 of neodymium coated with Teflon (registered trademark) and wrapped in a polyethylene mesh film 354. A second magnetic removal portion 362 is connected to the plating solution supply pipe 308 downstream of the filter 305 and positioned between the filter 305 and the three-way valve 306. The second magnetic removal portion 362 comprises, for example, a housing 358 and a plurality of permanent magnets 360 each having a size ranging from 5 to 20 mm and coated with Teflon (registered trademark). A mesh 364 is mounted on the downstream end of the housing 358 for preventing the permanent magnets 360 from flowing out of the housing 358. The coated permanent magnets 352, 360 of the first and second magnetic removal portions 356, 362 may be covered with a removable cover of a plastic material such as Teflon (registered trademark).

In this embodiment, the first and second magnetic removal portions 356, 362 have the permanent magnets 352, 360. However, devices for magnetically affecting the plating solution, such as electromagnets or the like, may be used instead of the permanent magnets 352, 360.

The first and second magnetic removal portions 356, 362 serve to magnetically remove small magnetic suspended solids which cannot be removed by the filter 305 and have a size of several tens nm or less, e.g., magnetic contaminants which have not been removed by the chemical solution but have been trapped in the electroless plating solution, and the catalytic metal released into the electroless plating solution, from the electroless plating solution.

For example, CMP residuals of, e.g., copper and foreign matter remain on a surface of a substrate such as a semiconductor wafer or the like which has been polished by the CMP process. It is customary to remove (clean off) such CMP residuals and foreign matter from the surface of the substrate, using a chemical at normal temperature, such as diluted sulfuric acid or the like, prior to the electroless plating process. However, contaminants may not be fully removed by the chemical and may possibly remain unremoved on the surface of the substrate, and contaminants, which are not predicted by the chemical, may remain on the surface of the substrate. Such contaminants are trapped in the electroless plating solution and are present as suspended solids in the electroless plating solution. If the suspended solids are not removed by the filter, but are carried and attached to the surface of the substrate, then they are responsible for abnormal precipitates on the surface of the substrate. Abnormal precipitates are also caused by the catalytic metal released into the electroless plating solution.

According to the this embodiment, small magnetic suspended solids having a size of several tens nm or less, which have not been removed by the filter 305, are magnetically removed from the electroless plating solution by the magnetic removal portions 356, 362. Consequently, small magnetic suspended solids in the electroless plating solution are prevented from being attached to a surface of an insulating film or the like and hence from producing abnormal precipitates thereon. In addition, the properties of the electroless plating solution are rendered constant for a stable plating reaction.

When a certain amount of precipitates are deposited on the first magnetic removal portion 356, the first magnetic removal portion 356 is pulled out of the electroless plating solution in the plating solution reservoir tank 302. After the permanent magnets 352 are removed, the precipitates applied to the mesh film 354 are rubbed off or scraped off. Alternatively, the mesh film 354 may be processed by a chemical solution of nitric acid or the like. When the electroless plating solution is replaced, the second magnetic removal portion 362 is removed from the plating solution supply pipe 308 and then the permanent magnets 360 are taken out of the housing 358. The precipitates applied to the permanent magnets 360 are dissolved away by nitric acid or physically scraped off.

In this embodiment, the two magnetic removal portions, i.e., the first magnetic removal portion 356 and the second magnetic removal portion 362, are employed. However, only one of the magnetic removal portions may be employed. Alternatively, a third magnetic removal portion 365 comprising a permanent magnet or electromagnet for generating a magnetic field may be disposed outside of the plating solution recovery pipe 310, as indicated by the imaginary lines in FIG. 16, instead of or in addition to one or both of the first magnetic removal portion 356 and the second magnetic removal portion 362. If the third magnetic removal portion 365 is employed, then when the electroless plating solution is replaced, the third magnetic removal portion (magnets) 365 is removed from the plating solution recovery pipe 310 and precipitates deposited on the inner circumferential surface of the plating solution recovery pipe 310 are washed away and collected together with the plating solution.

A magnetic removal portion composed of magnets may be disposed outside of the housing of the filter 305, and precipitates deposited on an inner surface of the housing may be removed when the filter 305 is replaced.

A metal or a metal compound on which an electroless plating reaction can take place may be placed in the electroless plating solution, and a magnetic removal portion may apply a magnetic field to the metal or the metal compound to magnetically attract magnetic suspended solids in the electroless plating solution. In this manner, the magnetic suspended solids may be collected (removed) during the plating reaction, and a constant area for collecting suspended solids may be provided. This arrangement makes it possible to reduce the surface area of suspended solids more effectively than if the suspended solids are attracted only to the magnetic removal portions (magnets).

An experiment was conducted in which the magnetic removal portions employed neodymium magnets, ions of palladium as a metal catalyst were dropped into a CoWP electroless plating solution to forcibly cause a self-decomposition reaction, and amounts of precipitates produced when magnets (magnetic removal portions) were applied to the plating solution and when magnets (magnetic removal portions) were not applied to the plating solution were compared. The result of the experiment indicated that the amount of precipitates was smaller when the magnets (magnetic removal portions) were applied to the plating solution.

A magnetic removal portion of magnets may be disposed in facing relation to the surface (to be plated) of the substrate to prevent suspended solids during the plating process from being deposited on the insulating film or the like of the substrate. This arrangement is applicable to both a circulatory process in which an electroless plating solution is used in circulation and a one-pass process in which a small amount of electroless plating solution is used only once without being recovered.

The thermometer 266 provided in the vicinity of the bottom of the plating tank 200 measures the temperature of the electroless plating solution to be introduced into the plating tank 200 and controls a heater 316 and a flow meter 318 described below based on the measurement results.

Specifically, in this embodiment, there are provided a heating device 322 for heating the electroless plating solution indirectly by a heat exchanger 320 provided in the electroless plating solution in the plating solution reservoir tank 302 and employing, as a heating medium, water that has been increased in temperature by a separate heater 316 and passed through the flow meter 318, and a stirring pump 324 for circulating the electroless plating solution in the plating solution reservoir tank 302 to stir the electroless plating solution. This is because the apparatus should be arranged so that the apparatus can cope with a case where the electroless plating solution is used at a high temperature (about 80° C.). This method can prevent an extremely delicate electroless plating solution from being mixed with foreign matter or the like, unlike an in-line heating method.

According to this embodiment, the electroless plating solution is set such that a temperature of the substrate is 70 to 90° C. during plating by bringing it into contact with the substrate W, and is controlled such that the range of variations in liquid temperature is within ±2° C.

The plating solution reservoir tank 302 is provided with a liquid level sensor 342 for measuring the liquid level of the electroless plating solution in the plating solution reservoir tank 302 to determine the decrease in an amount of water in the electroless plating solution due to the evaporation. Based on signals from the liquid level sensor 342, pure water (ultrapure water) is supplied to the electroless plating solution in the plating solution reservoir tank 302 so that a shortage of water in the electroless plating solution is replenished.

The electroless plating apparatus 16 is also provided with a plating solution composition analyzing section 330 for analyzing the composition of the plating solution held by the electroless plating apparatus 16 by, for example, absorption spectroscopy, titration, or an electrochemical measurement.

The plating solution component analyzing section 330 measures, for example, the concentration of cobalt ion by absorbance analysis, ion chromatography analysis, capillary electrophoresis analysis or chelatometry analysis; the concentration, in terms of tungsten, of tungstate by capillary electrophoresis analysis; the concentration of hypophosphite ion and/or dimethylamine borane by redox titration analysis or capillary electrophoresis analysis; and the concentration of a chelating agent by chelatometry analysis or capillary electrophoresis analysis. The concentration in terms of tungsten may also be calculated and determined from the consumption of Co ion or Ni ion.

The electroless plating apparatus 16 also includes a component replenishment section 340 for replenishing the plating solution with a shortage of a component based on the results of the above analyses. The following replenisher solutions may be supplied from the component replenishment section 340 to the plating solution: a solution containing a cobalt ion to replenish the plating solution with a shortage of cobalt ion; a solution containing tungstic acid to replenish the plating solution with a shortage of tungstic acid; a solution containing a hypophosphite ion and/or dimethylamine borane to replenish the plating solution with a shortage of hypophosphite ion and/or dimethylamine borane; a solution containing a chelating agent to replenish the plating solution with a shortage of chelating agent; and a solution containing a pH adjustment agent to correct a change in the pH of the plating solution.

Also when thus replenishing the plating solution with a consumed component according to necessity, a replenish solution containing that component is preferably preheated to the temperature of the plating solution so that the temperature of the plating solution will not be lowered.

The plating solution storage tank 302 is provided with a film-formation measurement section which includes a crystal oscillator to be immersed in the plating solution, and measures the rate of the formation of a protective film 9 by utilizing attenuation of the oscillation frequency of the crystal oscillator with deposition of an electroless plated film on the crystal oscillator. The film-formation rate of the protective film 9 during its formation can thus be measured by the measurement section.

By measuring the film-formation rate of the protective film 9 during its formation, it becomes possible to check whether the film-formation rate meets a predetermined rate. Further, by controlling the plating time based on the results of measurement of the film-formation rate of the protective film 9, in particular, by increasing or decreasing the plating time according to necessity when excess or deficiency in the film-formation rate is revealed, an alloy film having a predetermined thickness can be formed with good reproducibility.

When an electroless plating solution is used repeatedly, a particular component can accumulate in the plating solution by supply from the outside or self-decomposition of the plating solution, which could adversely affect the reproducibility of plating and the quality of a plated film. Provision of a mechanism for selective removal of such a component can extend the life of the plating solution and enhance the reproducibility of plating.

The following is an example of a basic composition of a plating solution for use in the electroless plating apparatus 16:

| Basic composition of plating solution | |
|---|---|
| $CoSO_4 \cdot 7H_2O$ | 7 g/L |
| $Na_3C_6H_5O_7 \cdot 2H_2O$ | 44 g/L |
| $H_3BO_3$ | 15 g/L |
| $Na_2WO_4 \cdot 2H_2O$ | 6 g/L |
| $Na_2H_2PO_2 \cdot H_2O$ | 10 g/L |

In electroless plating, the plating rate is higher at a higher temperature of plating solution, and a plating reaction does not occur at a too low temperature. In view of this, the temperature of the plating solution is generally 60 to 95° C., preferably 65 to 85° C., more preferably 70 to 75° C. It is basically desirable not to lower the temperature of the plating solution after once raising the temperature, regardless of whether plating is actually being carried out or not, and to keep the plating solution at a temperature of not less than 55° C.

Figure 15:
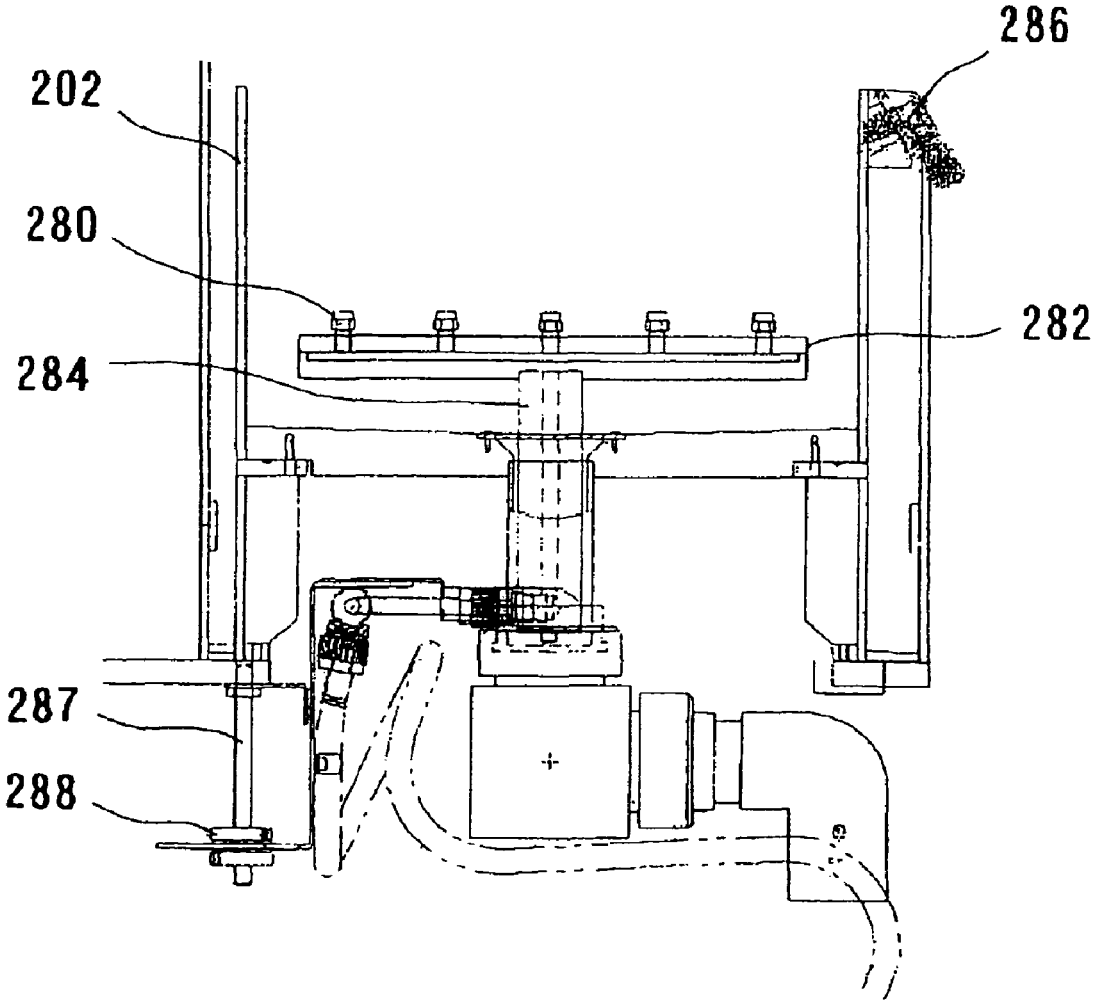
FIG. 15 is a cross-sectional view showing a cleaning tank of the electroless plating apparatus.

FIG. 15 shows the details of a cleaning tank 202 provided beside the plating tank 200. At the bottom of the cleaning tank 202, there is provided a nozzle plate 282 onto which a plurality of ejection nozzles 280 for ejecting a rinsing liquid such as pure water upward are attached. The nozzle plate 282 is coupled to an upper end of a nozzle vertical shaft 284. The nozzle vertical shaft 284 can be moved vertically by changing positions of engagement between a nozzle position adjustment screw 287 and a nut 288 engaging the screw 287 so as to optimize a distance between the ejection nozzles 280 and the substrate W disposed above the ejection nozzles 280.

Further, on the outer surface of the peripheral wall of the cleaning tank 202 and at a position higher than the ejection nozzles 280, there is provided a head cleaning nozzle 286 for ejecting a cleaning liquid such as pure water slightly downward with respect to a diametric direction in the cleaning tank 202 to blow the cleaning liquid to at least a portion of the head portion 232 of the substrate head 204 which is brought into contact with the plating solution.

In the cleaning tank 202, the substrate W held in the head portion 232 of the substrate head 204 is located at a predetermined position in the cleaning tank 202. A cleaning liquid (rinsing liquid) such as pure water is ejected from the ejection nozzles 280 to clean (rinse) the substrate W. At that time, a cleaning liquid such as pure water is ejected from the head cleaning nozzle 286 to clean, with the cleaning liquid, at least a portion of the head portion 232 of the substrate head 204 which is brought into contact with the electroless plating solution, thereby preventing a deposit from accumulating on a portion which is immersed in the electroless plating solution.

According to this electroless plating apparatus 16, when the substrate head 204 is in a lifted position, the substrate W is attracted to and held in the head portion 232 of the substrate head 204 as described above, while the electroless plating solution in the plating tank 200 is circulated.

When a plating process is performed, the plating tank cover 270 of the plating tank 200 is opened, and the substrate head 204 is lowered while being rotated. Thus, the substrate W held in the head portion 232 is immersed in the electroless plating solution in the plating tank 200.

After immersing the substrate W in the electroless plating solution for a predetermined period of time, the substrate head 204 is raised to lift the substrate W from the electroless plating solution in the plating tank 200 and, as needed, pure water (stop liquid) is ejected from the ejection nozzles 268 toward the substrate W to immediately cool the substrate W, as described above. The substrate head 204 is further raised to lift the substrate W to a position above the plating tank 200, and the rotation of the substrate head 204 is stopped.

Next, while the substrate W is attracted to and held in the head portion 232 of the substrate head 204, the substrate head 204 is moved to a position right above the cleaning tank 202. While the substrate head 204 is rotated, the substrate head 204 is lowered to a predetermined position in the cleaning tank 202. A cleaning liquid (rinsing liquid) such as pure water is ejected from the ejection nozzles 280 to clean (rinse) the substrate W. At that time, a cleaning liquid such as pure water is ejected from the head cleaning nozzle 286 to clean at least a portion of the head portion 232 of the substrate head 204 which is brought into contact with the electroless plating solution.

After completion of cleaning of the substrate W, the rotation of the substrate head 204 is stopped, and the substrate head 204 is raised to lift the substrate W to a position above the cleaning tank 202. Further, the substrate head 204 is moved to a transfer position between the second substrate transport robot 26 and the substrate head 204. Then, the substrate W is delivered to the second substrate transport robot 26 and is transferred to a subsequent process.

It has been confirmed that the life of the electroless plating solution can be extended when plating is performed with use of this electroless plating apparatus while magnetically removing the small magnetic suspended solids in an electroless plating solution.

Figure 17:
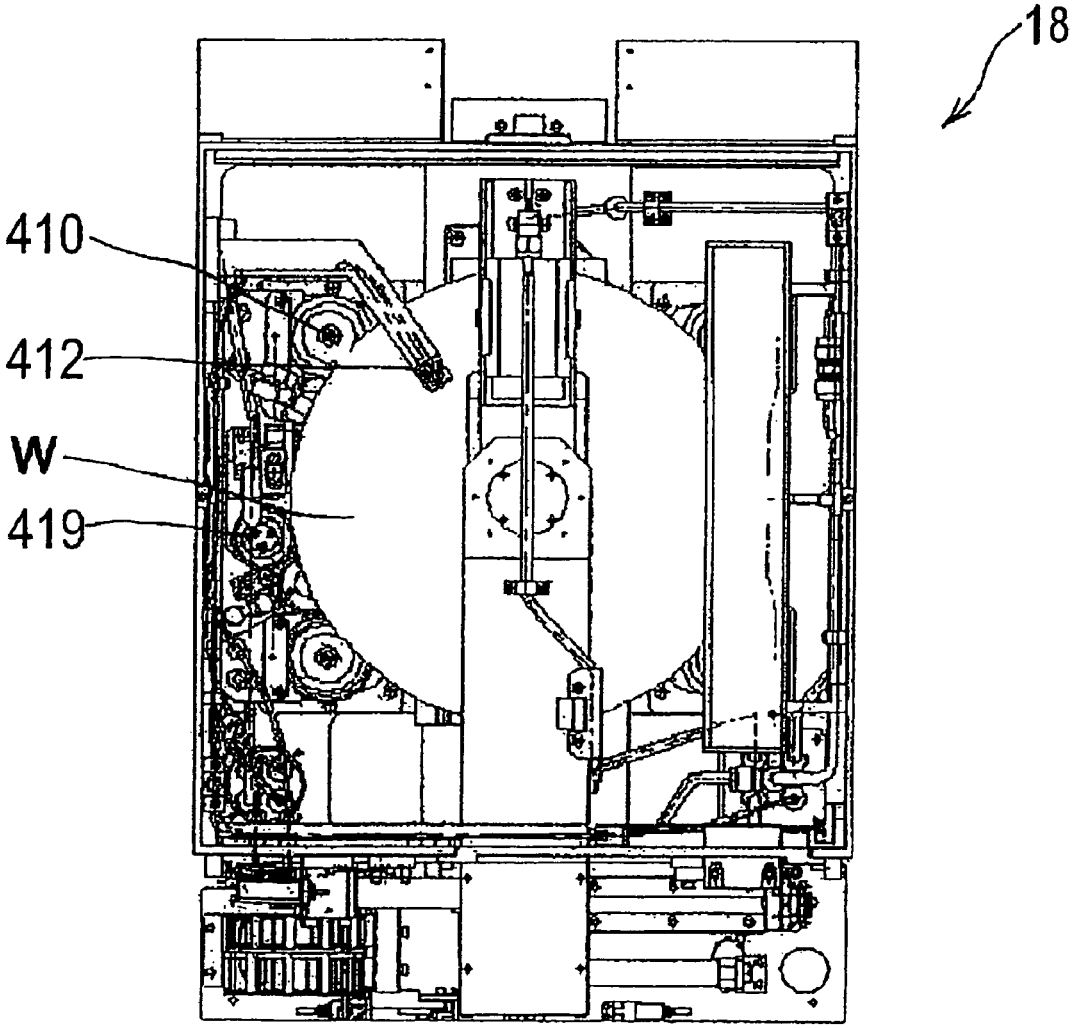
FIG. 17 is a plan view showing the post-processing apparatus.

FIG. 17 shows the post-processing apparatus 18. The post-processing apparatus 18 is an apparatus for forcibly removing particles and unnecessary matters on the substrate W with a roll-shaped brush, and includes a plurality of rollers 410 for holding the substrate W by nipping its peripheral portion, a chemical nozzle 412 for supplying a chemical liquid (two lines) to the front surface of the substrate W held by the rollers 410, and a pure water nozzle (not shown) for supplying pure water (one line) to the back surface of the substrate W.

In operation, the substrate W is held by the rollers 410 and a roller drive motor is driven to rotate the rollers 410 and thereby rotate the substrate W, while predetermined chemical liquids are supplied from the chemical nozzle 412 and the pure water nozzle to the front and back surfaces of the substrate W, and the substrate W is nipped between not-shown upper and lower roll sponges (roll-shaped brushes) at an appropriate pressure, thereby cleaning the substrate W. It is also possible to rotate the roll sponges independently so as to increase the cleaning effect.

The post-processing apparatus 18 also includes a sponge (PFR) 419 that rotates while contacting the edge (peripheral portion) of the substrate W, thereby scrub-cleaning the edge of the substrate W.

Figure 18:
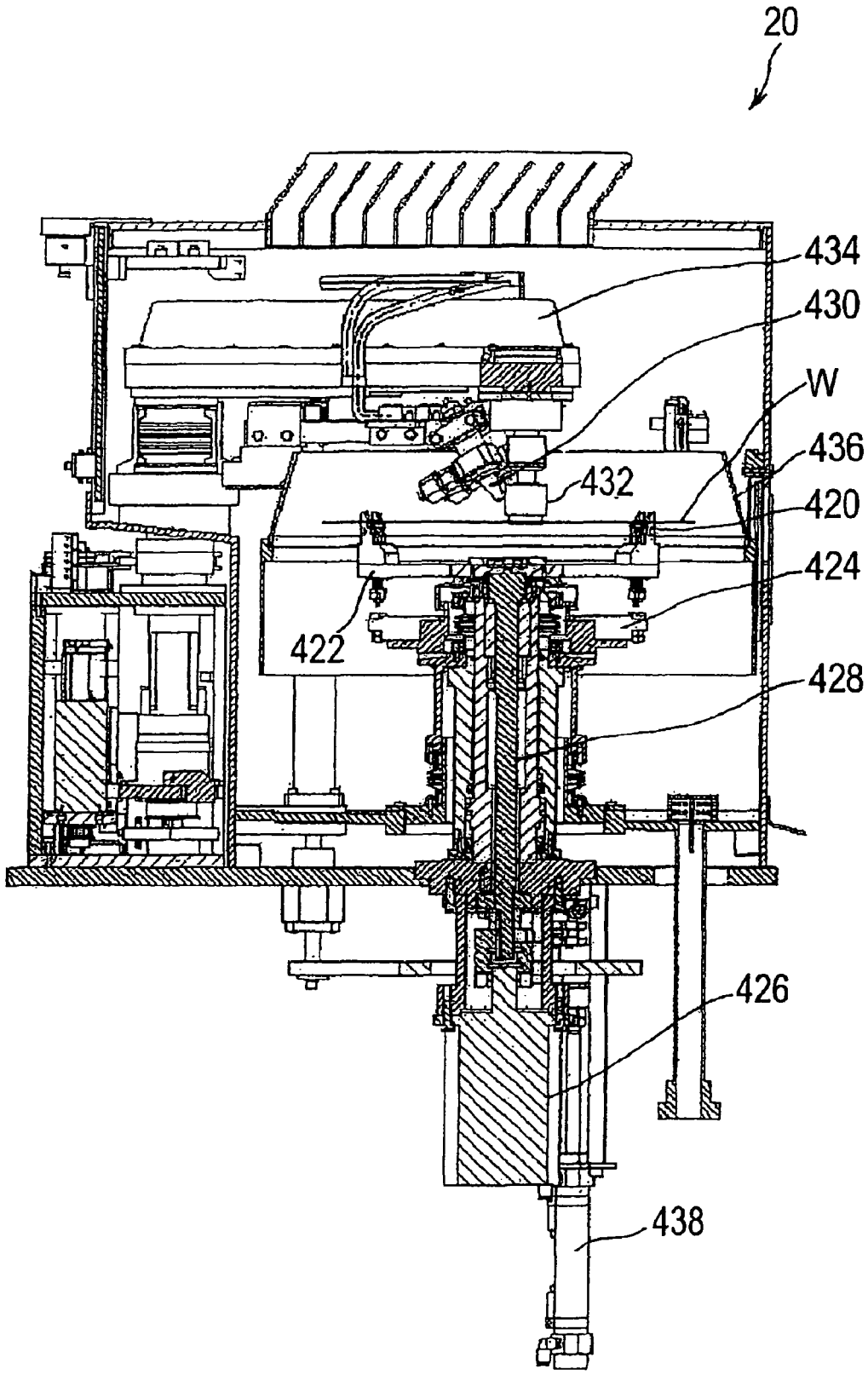
FIG. 18 is a vertical cross-sectional view showing a drying apparatus.

FIG. 18 shows the drying apparatus 20. The drying apparatus 20 is an apparatus for first carrying out chemical cleaning and pure water cleaning of the substrate W, and then fully drying the cleaned substrate W by spindle rotation, and includes a substrate stage 422 provided with a clamping mechanism 420 for clamping an edge portion of the substrate W, and a substrate attachment/detachment lifting plate 424 for opening/closing the clamping mechanism 420. The substrate stage 422 is coupled to the upper end of a spindle 428 that rotates at a high speed by the actuation of a spindle rotating motor 426.

Further, positioned on the side of the upper surface of the substrate W clamped by the clamping mechanism 420, there are provided a mega-jet nozzle 430 for supplying pure water to which ultrasonic waves from a ultrasonic oscillator have been transmitted during its passage through a special nozzle to increase the cleaning effect, and a rotatable pencil-type cleaning sponge 432, both mounted to the free end of a pivot arm 434. In operation, the substrate W is clamped by the clamping mechanism 420 and rotated, and the pivot arm 434 is pivoted while pure water is supplied from the mega-jet nozzle 430 to the cleaning sponge 432 and the cleaning sponge 432 is rubbed against the front surface of the substrate W, thereby cleaning the front surface of the substrate W. A cleaning nozzle (not shown) for supplying pure water is provided also on the side of the back surface of the substrate W, so that the back surface of the substrate W can also be cleaned with pure water sprayed from the cleaning nozzle at the same time.

The thus-cleaned substrate W is spin-dried by rotating the spindle 428 at a high speed.

A cleaning cup 436, surrounding the substrate W clamped by the clamping mechanism 420, is provided for preventing scattering of a cleaning liquid. The cleaning cup 436 is designed to move up and down by the actuation of a cleaning cup lifting cylinder 438.

It is also possible to provide the drying apparatus 20 with a cavi-jet function utilizing cavitation.

Next, a description will now be given of a series of substrate processings (electroless plating processings) as carried out by this substrate processing apparatus. In this example, as shown in FIG. 1, a protective film (cap material) 9 of a CoWP alloy is selectively formed to protect the interconnects 8.

First, one substrate W is taken by the first substrate transport robot 24 out of the cassette set in the loading/unloading unit 11 and housing substrates W with their front surfaces facing upwardly (face up), each substrate W having been subjected to the formation of interconnects 8 in the surface, and the substrate W is transported to the temporary storage table 22 and placed on it. The substrate W on the temporary storage table 22 is transported by the second substrate transport robot 26 to the first pre-processing apparatus 14*a*.

In the first pre-processing apparatus 14*a*, the substrate W is held face down, and a pre-cleaning with a cleaning liquid (processing liquid) is performed onto a surface of the substrate W. Specifically, the substrate W is held by substrate holder 58, and then processing head 60 is positioned to cover the opening in the upper end of the inner tank 100*b*, as shown in FIG. 4. Then, the processing liquid (cleaning liquid) in the processing liquid tank 120 is ejected form the ejection nozzles 112*a* of the nozzle plate 120 disposed in the inner tank 100*b* to the substrate W, thereby etching away an oxide film or the like on interconnects 8 to activate the surfaces of interconnects 8. At the same time, CMP residues of, e.g. copper remaining on a surface of an insulating film 2 is removed. The processing head 60 is elevated to a predetermined position, and the lid 102 is moved to cover the opening in the upper end of the inner tank 100*b*. Then, the rinsing liquid such as pure water is ejected from the ejection nozzles 112*a* of the nozzle plate 112 on the upper surface of the lid 102 to the substrate W to clean (rinse) the substrate W. The substrate W is then transferred to the second pre-processing apparatus 14*b* by the second substrate transfer robot 26.

In the second pre-processing apparatus 14*b*, the substrate W is held face down, and a catalyst impartation process is performed onto the surface of the substrate W. Specifically, the substrate W is held by substrate holder 58, and then processing head 60 is positioned to cover the opening in the upper end of the inner tank 100*b*, as shown in FIG. 4. Then, the processing liquid (catalyst imparting solution) in the processing liquid tank 120 is ejected form the ejection nozzles 112*a* of the nozzle plate 120 disposed in the inner tank 100*b* to the substrate W so as to adhere Pd as a catalyst to the surfaces of the interconnects 8. More specifically, Pd cores are formed as catalyst cores (seeds) on the surfaces of the interconnects 8 to activate exposed surfaces of the interconnects 8. The processing head 60 is elevated to a predetermined position, and the lid 102 is moved to cover the opening in the upper end of the inner tank 100*b*. Then, the rinsing liquid such as pure water is ejected from the ejection nozzles 112*a* of the nozzle plate 112 on the upper surface of the lid 102 to the substrate W to clean (rinse) the substrate W. The substrate W is then transferred to the electroless plating apparatus 16 by the second substrate transfer robot 26.

In the electroless plating apparatus 16, the substrate head 204 holding the substrate W in a face-down manner is lowered to immerse the substrate W in the plating solution in the plating tank 200, thereby carrying out electroless plating (electroless CoWP plating). For example, the substrate W is immersed in a CoWP plating solution at a liquid temperature of 80° C., e.g. for about 120 seconds to carry out selective electroless plating (electroless CoWP cap plating) on the activated surfaces of interconnects 8.

After the substrate W is pulled up from the liquid surface of the plating solution, a stop liquid such as pure water is ejected from the ejection nozzle 268 toward the substrate W to replace the plating solution on the surface of the substrate W with the stop liquid and stop the electroless plating. Next, the substrate head 204 holding the substrate W is located at a predetermined position in the cleaning tank 202. Pure water is ejected from the ejection nozzles 280 of the nozzle plate 282 disposed in the cleaning tank 202 to clean (rinse) the substrate W. At the same time, pure water is ejected from the head cleaning nozzle 286 to the head portion 232 to clean the head portion 232. The protective film 9 of CoWP alloy is thus formed selectively on the surfaces of interconnects 8 to protect interconnects 8.

Next, the substrate W after the electroless plating is transported by the second substrate transport robot 26 to the post-processing apparatus 18, where the substrate W is subjected to post-plating processing (post-cleaning) in order to enhance the selectivity of the protective film (alloy film) 9 formed on the surface of the substrate W and thereby increase the yield. In particular, while applying a physical force to the surface of the substrate W, for example, by roll scrub cleaning or pencil cleaning, a post-plating processing liquid (chemical solution) is supplied onto the surface of the substrate W to thereby completely remove plating residues, such as fine metal particles, from the insulating film (interlevel dielectric film) 2, thus enhancing the selectivity of plating.

The substrate W after the post-plating process is transported by the second substrate transport robot 26 to the drying apparatus 20, where the substrate W is rinsed, according to necessity, and then rotated at a high speed to spin-dry the substrate W.

The spin-dried substrate W is placed by the second substrate transport robot 26 on the temporary storage table 22, and the substrate W placed on the temporary storage table 22 is returned by the first substrate transport robot 24 to the substrate cassette set in the loading/unloading unit 11.

Figure 19:
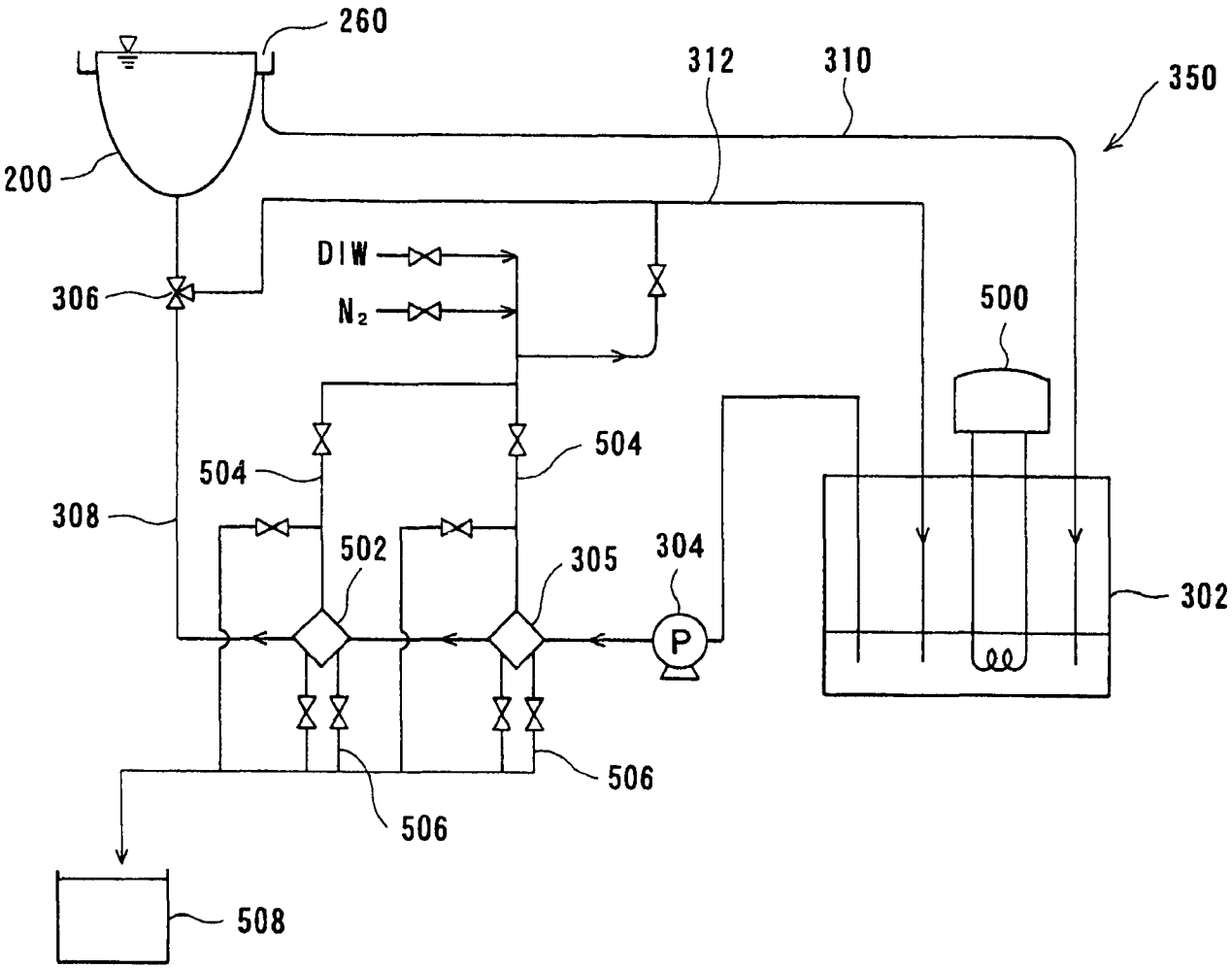
FIG. 19 is a system diagram showing an electroless plating apparatus according to another embodiment of the present invention.

FIG. 19 shows a system diagram of an electroless plating apparatus according to another embodiment of the present invention. Those parts in FIG. 19 which are identical to or correspond to those shown in FIG. 16 are denoted by identical reference characters, and will not be described in detail below.

A plating tank 200 has its bottom connected to a plating solution supply pipe 308 extending from a plating solution reservoir tank 302 and having a plating solution supply pump 304, a filter 305, and a three-way valve 306. The plating tank 200 has a plating solution recovery gutter 260 connected to a plating solution supply pipe 310 extending from the plating solution reservoir tank 302. The three-way valve 306 has an outlet port connected to a plating solution return pipe 312 connected to the plating solution reservoir tank 302. The plating tank 200, the plating solution supply pipe 310, the plating solution reservoir tank 302, the plating solution supply pipe 308, and the plating solution return pipe 312 jointly make up a plating solution circulating system 350. The plating solution reservoir tank 302 is provided with a heater 500 for heating the plating solution in the plating solution reservoir tank 302.

A magnetic removal portion in the form of a full-flow magnet filter 502 is connected to the plating solution supply pipe 308 at a position between the filter 305 and the three-way valve 306. The filter 305 and the magnet filter 502 have respective upper ends connected to cleaning liquid supply pipes 504 for introducing therein a cleaning liquid such as pure water (DIW) or the like and a purge gas such as an $N_2$ gas or the like. The filter 305 and the magnet filter 502 have respective lower ends connected to solution removal drainpipes 506 for removing the plating solution individually from inlet and outlet ports of the filter 305 and the magnet filter 502. The solution removal drainpipes 506 are connected to a waste liquid tank 508.

Figure 20:
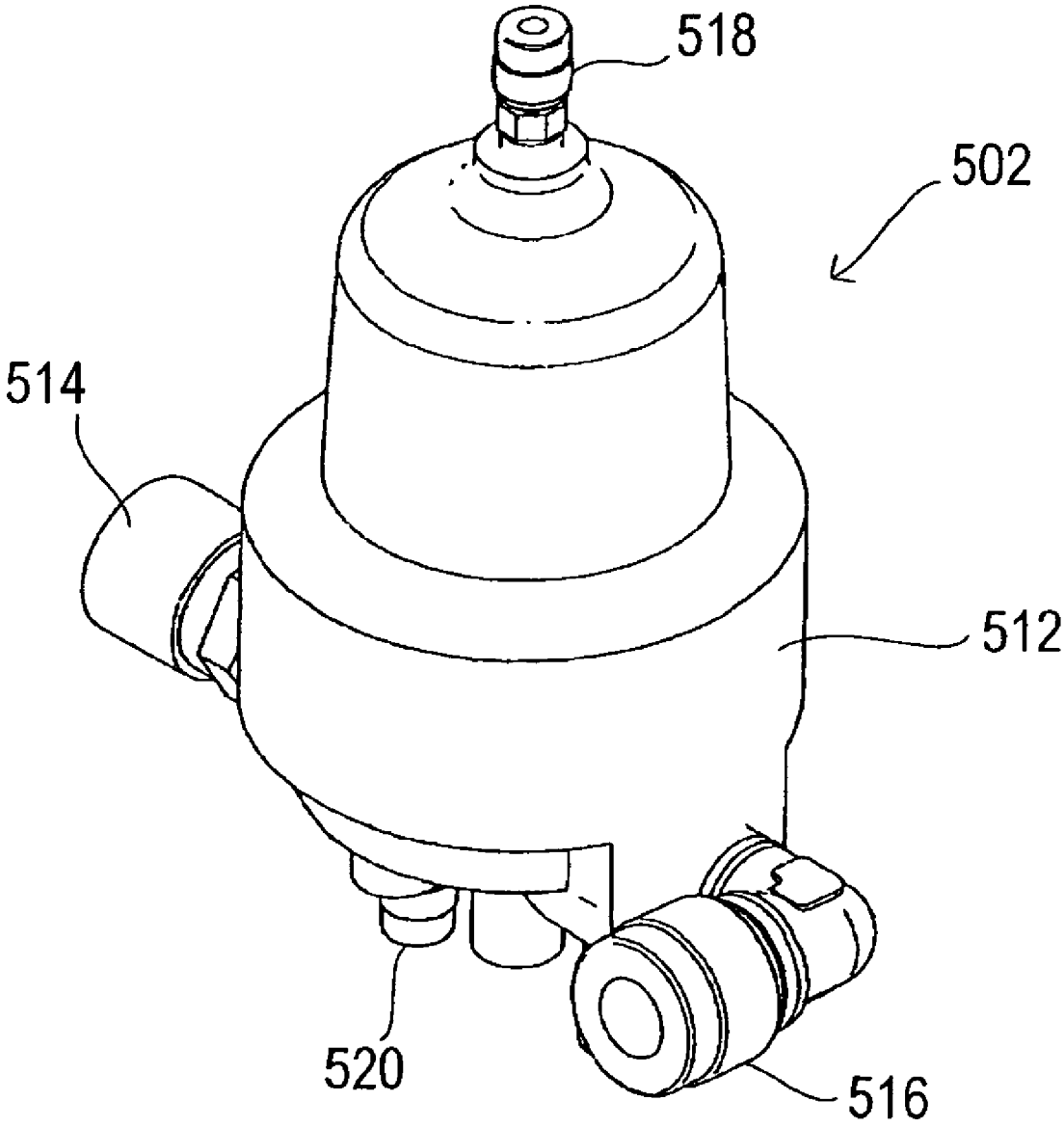
FIG. 20 is a perspective view of a magnetic filter.
Figure 21:
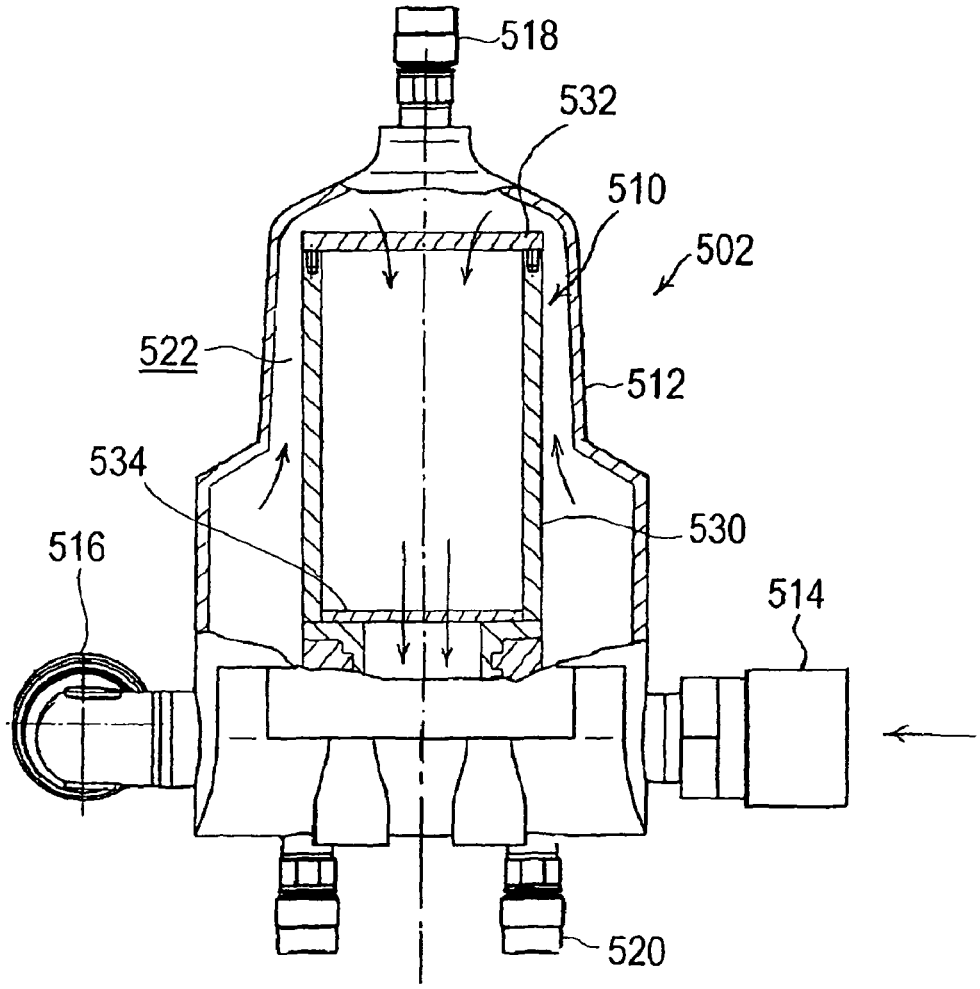
FIG. 21 is a front view, partly cut away, of the magnetic filter.

As shown in FIGS. 20 and 21, the magnet filter 502 primarily comprises a removable cartridge 510 and a housing 512 surrounding the cartridge 510 in a liquid-tight manner. The housing 512 has a plating solution inlet port 514 for introducing the plating solution flowing through the plating solution supply pipe 308 in its entirety into the housing 512, and a plating solution outlet port 516 for discharging the introduced plating solution out of the cartridge 510. The housing 512 and the cartridge 510 jointly define therebetween a plating solution path 522 communicating with the plating solution inlet port 514. The interior of the cartridge 510 communicates with the plating solution outlet port 516. The plating solution, which has flowed from the plating solution inlet port 514 into the housing 512, flows through the plating solution path 522 between the housing 512 and the cartridge 510 into the cartridge 510, passes through the cartridge 510, and then is discharged out of the cartridge 510 through the plating solution outlet port 516.

The housing 512 has a cleaning fluid inlet port 518 defined in its upper end which is connected to the cleaning fluid supply pipe 504, and waste liquid ports 520 defined in its lower end which are connected to the liquid removal drainpipes 506. The plating solution in the magnet filter 502 can be removed therefrom through the liquid removal drainpipes 506 without being trapped in the magnet filter 502.

Figure 22:
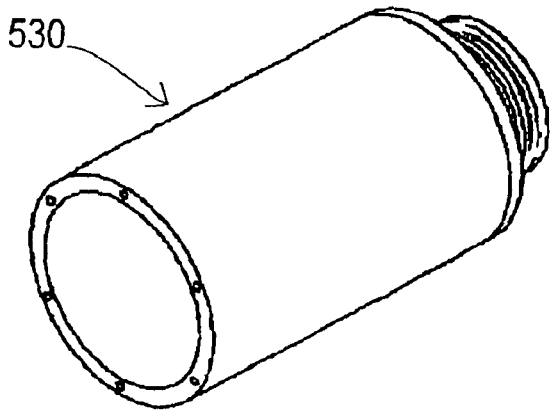
FIG. 22 is a perspective view of a cartridge casing.

The cartridge 510 comprises a cartridge casing 530 (see also FIG. 22) which is substantially cylindrical in shape to prevent localized plating solution flows from being developed therein, a cartridge cover 532 covering an opening in the upper end of the cartridge casing 530, and a cartridge seat plate 534 disposed on the lower end of the cartridge casing 530. The space in the cartridge casing 530, which extends between the cartridge cover 532 and the cartridge seat plate 534, is filled with a number of magnets 536 (see FIGS. 25 and 26). The cartridge casing 530, the cartridge cover 532, and the cartridge seat plate 534 are made of PTFE, for example. The magnets 536 are preferably coated with Teflon (registered trademark) for preventing iron particles from being introduced into the plating solution.

Figure 23:
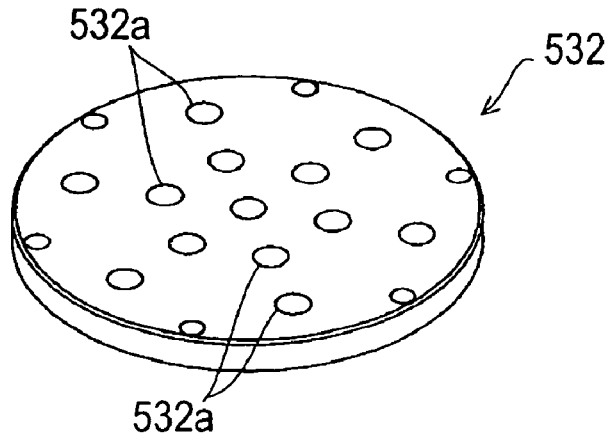
FIG. 23 is a perspective view of a cartridge cover.

As shown in FIG. 23, the cartridge cover 532 has a number of solution inlet holes 532*a* defined therein at predetermined pitches in radial and circumferential directions. When the plating solution passes through the solution inlet holes 532*a*, the plating solution flows in a dispersed state into the cartridge casing 530. The plating solution introduced into the cartridge casing 530 is prevented from flowing through short paths in the cartridge casing 530 without being held in sufficient contact with the magnets 536 in the cartridge casing 530.

Figure 24:
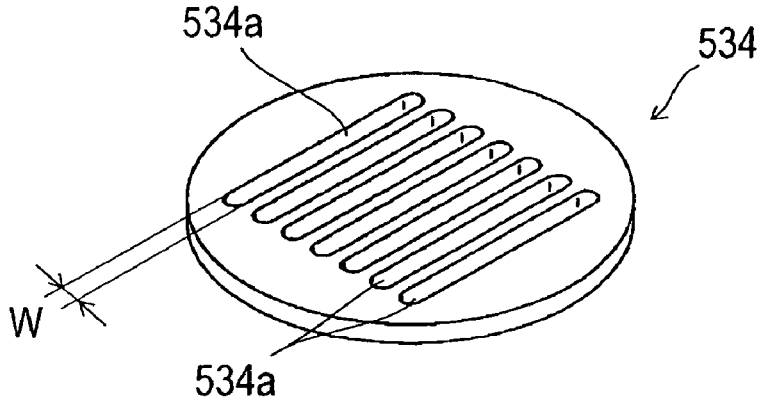
FIG. 24 is a perspective view of a cartridge seat plate.

As shown in FIG. 24, the cartridge seat plate 534 has a number of solution outlet holes 534*a* in the form of parallel slits. The solution outlet holes 534*a* thus have a large opening area and are not fully closed by the magnets 536. The opening area of the solution outlet holes 534*a* should preferably be greater than the opening area of the solution inlet holes 532*a* for keeping the plating solution flowing in the cartridge casing 530 in contact with the magnets 536 for a sufficient period of time.

Figure 25:
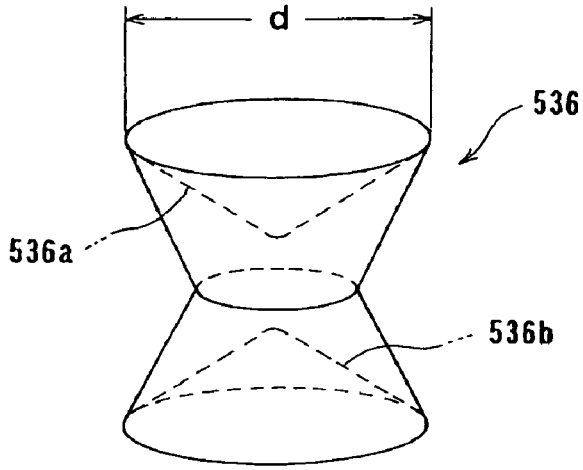
FIG. 25 is a perspective view of a magnet.

As shown in FIG. 25, each of the magnets 536 has a circular cross-sectional shape and is in the form of two truncated cones with their smaller ends joined to each other. The magnet 536 has conical recesses 536*a*, 536*b* defined respectively in upper and lower ends thereof for providing a large area of contact with the plating solution. However, each of the magnets 536 is not limited to the shape shown in FIG. 25, but may be of any of various shapes, e.g., a spherical shape. Each of the magnets 536 has a maximum diameter "d" slightly greater than the width "W" of each of the slits as the solution outlet holes 534*a*. Therefore, the magnets 536 are prevented from being displaced out of the cartridge casing 350 through the solution outlet holes 534*a*, and provide a maximum area of contact with the plating solution.

Figure 26:
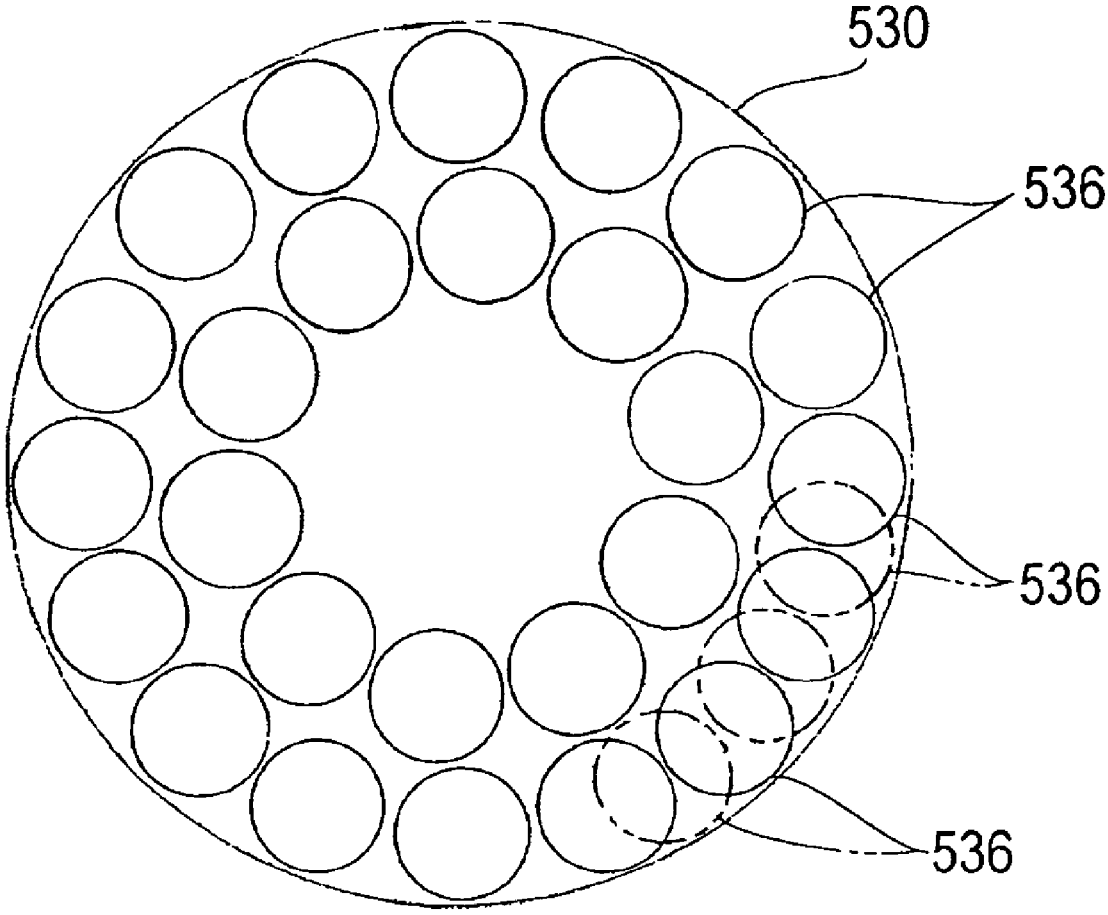
FIG. 26 is a view showing an example of magnets placed in the cartridge casing.

As shown in FIG. 26, the magnets 536 are placed successively radially inwardly in circular patterns, for example. The gap between two adjacent magnets 536 is preferably smaller than the size of one magnet, thereby preventing the magnets 536 from moving horizontally. The magnets 536 that are placed in circular patterns are vertically stacked in successive layers in the cartridge casing 530 such that the magnets 536 in an upper layer are staggered half of the magnet width with respect to the magnets 536 in a lower layer. The magnets 536 thus arranged are held in contact with the plating solution through a wide area.

The electroless plating apparatus according to this embodiment operates as follows: When the plating solution supply pump 304 is actuated, the plating solution in its entirety flows through the filter 305 into the magnet filter 502. In the magnet filter 502, the plating solution passes through the plating solution path 522 between the housing 512 and the cartridge 510, and then flows from the solution inlet holes 532*a* into the cartridge casing 530 where the plating solution is brought into contact with the magnets 536. Small magnetic suspended solids having a size of several tens nm or less, which have not been removed by the filter 305, are magnetically removed from the plating solution by the magnets 536. After the magnetic suspended solids, having a size of several tens nm or less, have been removed, the plating solution is discharged out of the cartridge casing 530 through the solution outlet holes 534*a* in the cartridge seat plate 534, and is supplied through the plating solution supply pipe 308 to the plating tank 200 or returned through the plating solution return pipe 312 to the plating solution reservoir tank 302.

The plating solution flows at a rate ranging from 1 to 10 L/min., for example. The plating solution flows in the magnet filter 502 at a linear velocity ranging from 0.5 to 7.0 cm/sec., for example, and flows through the solution inlet holes 532*a* in the cartridge cover 532 at a speed ranging from 0.065 to 0.65 cm/sec., for example.

A chemical solution, e.g., a solution of nitric acid in the range from 1 to 20% or preferably from 3 to 10% at 50° C. or preferably 60° C. or higher, is circulated through the system either when deposits on the magnets 536 are confirmed or at periodical intervals, for thereby dissolving away the deposits on the magnets 536. In this manner, the deposits on the magnets 536 can easily be removed. Alternatively, the cartridge 510 may be detached from the housing 512, and the cartridge 510 together with the magnets 536 may be immersed in a chemical solution, e.g., a solution of nitric acid at 50° C. or preferably 60° C. or higher, for a predetermined period of time for removing the deposits.

In the above embodiments, the interconnect material is copper (Cu), and the protective film 9 in the form of a CoWP alloy film is selectively formed on the surfaces of interconnects 8 of copper. However, the interconnect material may be a Cu alloy, Ag, or an Ag alloy, and the protective film may be a film of another cobalt alloy such as CoWB, CoP, CoB, or the like, or a film of a nickel alloy such as NiWP, NiWB, NiP, NiB, or the like.

In the above embodiments, the surfaces of interconnects 8 are activated, and the protective film (metal film) 9 is selectively formed on the surfaces of interconnects 8. However, the surface of the substrate with the interconnect recesses 4 shown in FIG. 1 may be activated, and the metal film may be formed on the activated surfaces.

Although certain preferred embodiments of the present invention have been shown and described in detail, it should be understood that various changes and modifications may be made therein without departing from the scope of the appended claims.

The invention claimed is:

1. An electroless plating apparatus, comprising:

a plating tank for holding a plating solution therein so as to perform an electroless plating process;

a substrate head for holding a substrate during the electroless plating process;

a plating solution reservoir tank for storing the plating solution therein; and a plating solution circulating system for circulating the plating solution between said plating tank and said plating solution reservoir tank, said plating solution circulating system including:

a plating solution recovery pipe; and a plating solution supply pipe having a filter and a magnetic removal portion downstream of said filter, said magnetic removal portion being configured to magnetically remove small magnetic solids suspended in the plating solution which have not been removed by said filter.

2. An electroless plating apparatus according to claim 1, wherein said magnetic removal portion comprises a full-flow magnet filter filled with a plurality of magnets, said full-flow magnet filter being configured to allow an entirety of the plating solution to flow through said magnet filter.

3. An electroless plating apparatus according to claim 2, wherein said magnet filter includes:

a removable cartridge with said magnets disposed therein; and a housing surrounding said cartridge in a liquid-tight manner, said magnet filter being configured such that the plating solution flows into a space between said cartridge and said housing, then flows into said cartridge, and then is discharged out of said cartridge.

4. An electroless plating apparatus according to claim 3, wherein said cartridge includes:

a cylindrical cartridge casing;

a cartridge cover having a plurality of solution inlet holes defined therein; and a cartridge seat plate having a plurality of solution outlet slits defined therein.

5. An electroless plating apparatus according to claim 1, further comprising a metal or a metal compound on which an electroless plating reaction can occur, said metal or metal compound being placed in the plating solution.

6. An electroless plating apparatus according to claim 1, wherein said electroless plating apparatus is operable to form a plated film of a cobalt alloy or a nickel alloy on the substrate.

7. An electroless plating apparatus according to claim 1, wherein said magnetic removal portion comprises a first magnetic removal portion, further comprising a second magnetic removal portion arranged in said plating solution reservoir tank so as to be immersed in the plating solution.

8. An electroless plating apparatus according to claim 1, wherein said magnetic removal portion comprises a first magnetic removal portion, further comprising a second magnetic removal portion arranged adjacent to said plating solution recovery pipe, said second magnetic removal portion comprising a permanent magnet or an electromagnet for generating a magnetic field.

9. An electroless plating apparatus according to claim 8, further comprising a third magnetic removal portion arranged in said plating solution reservoir tank so as to be immersed in the plating solution.

10. An electroless plating apparatus according to claim 1, wherein said plating solution reservoir tank has a shape free of corners on side and bottom surfaces thereof.

* * * * *